US009883269B2

(12) United States Patent
Miyatake et al.

(10) Patent No.: US 9,883,269 B2
(45) Date of Patent: Jan. 30, 2018

(54) NOTIFICATION DEVICE AND SIGNAL DISPLAY LIGHT

(71) Applicant: PATLITE CORPORATION, Osaka (JP)

(72) Inventors: Tetsuya Miyatake; Kazuya Nishimatsu, Osaka (JP); Yusuke Tone, Osaka (JP); Daisuke Shigematsu, Osaka (JP)

(73) Assignee: PATLITE CORPORATION, Osaka (JP)

( * ) Notice: Subject to any disclaimer, the term of this patent is extended or adjusted under 35 U.S.C. 154(b) by 0 days.

(21) Appl. No.: 15/322,332

(22) PCT Filed: Feb. 18, 2015

(86) PCT No.: PCT/JP2015/054429
§ 371 (c)(1),
(2) Date: Dec. 27, 2016

(87) PCT Pub. No.: WO2016/002248
PCT Pub. Date: Jan. 7, 2016

(65) Prior Publication Data

US 2017/0134838 A1 May 11, 2017

(30) Foreign Application Priority Data

Jul. 1, 2014 (JP) ..... 2014-135994

(51) Int. Cl.
*H04R 1/02* (2006.01)
*H04R 1/34* (2006.01)
(Continued)

(52) U.S. Cl.
CPC ..... *H04R 1/028* (2013.01); *H04R 1/02* (2013.01); *H04R 1/345* (2013.01); *F21V 3/02* (2013.01);
(Continued)

(58) Field of Classification Search
CPC ..... H04R 1/028; H04R 1/345; H04R 1/02; H04R 2499/11; F21V 31/00; F21V 3/02; F21Y 2115/10; F21W 2499/11
(Continued)

(56) References Cited

U.S. PATENT DOCUMENTS

2006/0187075 A1* 8/2006 Stirling ..... G08B 7/06 340/691.1

FOREIGN PATENT DOCUMENTS

JP S55-89898 A 7/1980
JP S63-44589 U 3/1988
(Continued)

OTHER PUBLICATIONS

International Preliminary Examination Report dated Jan. 12, 2017 for PCT Application No. PCT/JP2015/054429.
(Continued)

*Primary Examiner* — Melur Ramakrishnaiah
(74) *Attorney, Agent, or Firm* — Plumsea Law Group, LLC

(57) ABSTRACT

A main body case 9 includes an output opening 43 for outputting sound from a sound source to an opposing space between an upper main wall 33 and a lower main wall 34. The main body case 9 includes a front main wall 41 for preventing entering of a water droplet to the output opening 43 and for guiding the sound to a rear side B, and a rear main wall 35 for reflecting the sound to a front side F. A first space 51 between the front main wall 41 and the rear main wall 35, a second space 52 surrounded by a left surface 41C of the front main wall 41 and the rear main wall 35 and the upper main wall 33 and the lower main wall 34 and a third space 53 surrounded by a right surface 41D the front main wall 41 and the rear main wall 35 and the upper main wall 33 and the lower main wall 34 are communicating with one another
(Continued)

along a crosswise direction Y at a rear end part of each of these spaces.

20 Claims, 25 Drawing Sheets

(51) Int. Cl.

| | |
|---|---|
| *F21Y 115/10* | (2016.01) |
| *F21V 3/02* | (2006.01) |
| *F21W 111/00* | (2006.01) |
| *F21V 31/00* | (2006.01) |

(52) U.S. Cl.
CPC ..... *F21V 31/00* (2013.01); *F21W 2111/00* (2013.01); *F21Y 2115/10* (2016.08); *H04R 2499/11* (2013.01)

(58) Field of Classification Search
USPC ..... 381/334, 345, 394, 333, 300, 304; 340/384, 1, 331, 332, 627, 683.12, 693.5; 579/430
See application file for complete search history.

(56) References Cited

FOREIGN PATENT DOCUMENTS

| | | | |
|---|---|---|---|
| JP | H09-149487 | A | 6/1997 |
| JP | 2009017132 | A | 1/2009 |
| JP | 2009017132 | A | 7/2012 |
| JP | 2012142659 | A | 7/2012 |
| JP | 2014098741 | A | 5/2014 |

OTHER PUBLICATIONS

International Search Report and Written Opinion dated Mar. 24, 2015 for PCT Application No. PCT/JP2015/054429.

* cited by examiner

NOTIFICATION DEVICE AND SIGNAL DISPLAY LIGHT

CROSS-REFERENCE TO RELATED APPLICATION(S)

This application is the U.S. National Phase application of PCT application number PCT/JP2015/054429 having a PCT filing date of Feb. 18, 2015, which claims priority of Japanese patent application 2014-135994 filed on Jul. 1, 2014, the disclosures of which are hereby incorporated by reference.

TECHNICAL FIELD

This invention relates to a notification device and a signal indicator lamp including the notification device.

BACKGROUND OF RELATED ART

A signal indicator lamp disclosed in following patent literature 1 includes a cylindrical shape extending in a vertical direction and is configured by connecting indicator units and an acoustic notification unit. A circular opening part is formed at a side surface of a cylindrical case having an approximately cylindrical shape of the acoustic notification unit. A lid with a loudspeaker throat part is mounted to the opening part. The opening part includes a cylindrical part extending in a horizontal direction. A communicating hole is formed downward in the vertical direction at an upper part of an inner wall surface of the cylindrical part. A sound source setting part for storing and supporting a speaker and a mounting substrate of the speaker is integrally formed with an inner surface of the cylindrical case at an upper side of the communicating hole. Sound wave generated from the speaker is guided from the communicating hole and goes to a lower side in the loudspeaker throat part. Then, the sound wave is emitted in the horizontal direction from an acoustic radiating aperture of the loudspeaker throat part.

CITATION LIST

Patent Literature

Patent Literature 1: Japanese Patent Application Publication No. 2009-17132

SUMMARY OF THE INVENTION

Technical Problem

In a notification device such as the acoustic notification unit disclosed in the patent literature 1, improvement of waterproofness is required in order to prevent getting wet of inner parts such as the speaker in case of use in a water splash-prone environment.

This invention was done under such a background and this invention is intended to provide a notification device which can improve waterproofness and a signal indicator lamp including the notification device.

Solution to Problem

An invention of claim 1 is a notification device (3) for notifying sound to a front side (F) including: a sound source (14) and a main body case (9) including an upper main wall (33) extending longitudinally and laterally, a lower main wall (34) extending longitudinally and laterally and opposing to the upper main wall from a lower side (D), and an output opening (43) for outputting sound from the sound source to an opposing space (32) between the upper main wall and the lower main wall from an upper side (U), wherein the main body case includes: a front main wall (41) provided at a front side of the output opening and bridged between the upper main wall and the lower main wall, the front main wall for preventing entering of a water droplet to the output opening from a front side and for guiding sound outputted from the output opening to a rear side (B) and a rear main wall (35) extending vertically and laterally and opposing to an output opening side of the front main wall from a rear side with an interval, the rear main wall for reflecting the sound outputted from the output opening to a front side, wherein a first space (51) between the front main wall and the rear main wall, a second space (52) surrounded by a left surface (41C) of the front main wall and the rear main wall and the upper main wall and the lower main wall, and a third space (53) surrounded by a right surface (41D) of the front main wall and the rear main wall and the upper main wall and the lower main wall are communicating with one another along a crosswise direction (Y) at a rear end part of each of the first space, the second space and the third space.

An invention of claim 2 is the notification device according to claim 1, wherein the main body case includes: a left main wall (46) bridged between the upper main wall and the lower main wall at a position spaced to a left side (L) from the front main wall and spaced to a front side from the rear main wall, the left main wall for guiding sound reflected to a front side at the rear main wall to a front side and a right main wall (47) bridged between the upper main wall and the lower main wall at a position spaced to a right side (R) from the front main wall and spaced to a front side from the rear main wall, the right main wall for guiding sound reflected to a front side at the rear main wall to the front side, wherein the second space is divided into a fourth space (54) on a left side and a fifth space (55) on a right side by the left main wall, the third space is divided into a sixth space (56) on a left side and a seventh space (57) on a right side by the right main wall, the first space, the fourth space, the fifth space, the sixth space and the seventh space are communicating with one another along the crosswise direction at a rear end part of each of the first space, the fourth space, the fifth space, the sixth space and the seventh space.

An invention of claim 3 is the notification device according to claim 2, wherein each part communicating along the crosswise direction of the first space, the fourth space, the fifth space, the sixth space and the seventh space is penetrating the main body case along the crosswise direction.

An invention of claim 4 is the notification device according to claim 2 or 3, wherein the front main wall, the left main wall and the right main wall are integrally molded with the main body case.

An invention of claim 5 is the notification device according to any one of claims 2 to 4, wherein a front surface (35A) of the rear main wall is a flat surface.

An invention of claim 6 is the notification device according to any one of claims 2 to 5, wherein a rear surface (41B) of the front main wall is convexly curved to a front side.

An invention of claim 7 is the notification device according to any one of claims 2 to 6, wherein each front tip part (41A, 46A, 47A) of the front main wall, the left main wall and the right main wall is extended to the neighborhood of an outer edge of the main body case.

An invention of claim 8 is a notification device (1) including a signal unit (2) for transmitting predetermined signal and an acoustic unit (3) connected with the signal unit for notifying sound to a front side (F), wherein the acoustic unit includes: a sound source (14) and a main body case (9) including an upper main wall (33) extending longitudinally and laterally, a lower main wall (34) extending longitudinally and laterally and opposing to the upper main wall from a lower side (D), and an output opening (43) for outputting sound from the sound source to an opposing space (32) between the upper main wall and the lower main wall from an upper side (U), wherein the main body case includes: a front main wall (41) provided at a front side (F) of the output opening and bridged between the upper main wall and the lower main wall, the front main wall for preventing entering of a water droplet to the output opening from a front side and for guiding sound outputted from the output opening to a rear side (B) and a rear main wall (35) extending vertically and laterally and opposing to an output opening side of the front main wall from a rear side with an interval, the rear main wall for reflecting sound outputted from the output opening to a front side, wherein a first space (51) between the front main wall and the rear main wall, a second space (52) surrounded by a left surface (41C) of the front main wall and the rear main wall and the upper main wall and the lower main wall, and a third space (53) surrounded by a right surface (41D) of the front main wall and the rear main wall and the upper main wall and the lower main wall are communicating with one another along a crosswise direction (Y) at a rear end part of each of the first space, the second space and the third space.

An invention of claim 9 is a signal indicator lamp (1) including the notification device according to any one of claims 1 to 8, further including a signal unit for transmitting predetermined signal at least one of an upper side and a lower side of the main body case.

An invention of claim 10 is the signal indicator lamp according to claim 9, wherein the main body case includes a space (61) for a wiring of the signal unit at a rear side of the main body case.

Effect of Invention

According to an invention of claims 1, 8 and 9, the output opening outputs sound from the sound source to the opposing space between the upper main wall and the lower main wall from an upper side in the main body case of the notification device (the acoustic unit). The front main wall provided at a front side of the output opening guides sound outputted from the output opening to a rear side and the rear main wall opposing to an output opening side of the front main wall from a rear side with an interval reflects sound outputted from the output opening to a front side in the main body case. Thereby, the sound outputted from the output opening is notified to a front side in the notification device.

In this case, the front main wall prevents entering of a water droplet to the output opening from a front side. Also, the first space between the front main wall and the rear main wall, the second space surrounded by the left surface of the front main wall and the rear main wall and the upper main wall and the lower main wall and the third space surrounded by the right surface of the front main wall and the rear main wall and the upper main wall and the lower main wall are communicating with one another along the crosswise direction at a rear end part of each of the first space, the second space and the third space. Thereby, if water enters into any one of the first to third spaces, this water flows in the rear end part of each of these spaces along the crosswise direction. Therefore, this water easily exits from the main body case without entering the output opening.

As a result, waterproofness can be improved because it is difficult for water splashing onto the main body case to reach the output opening.

According to an invention of claim 2, the left main wall divides the second space into the fourth space on a left side and the fifth space on a right side, and the right main wall divides the third space into the sixth space on a left side and the seventh space on a right side. Due to these left main wall and right main wall, sound volume of the notification device can be improved by guiding sound reflected to a front side at the rear main wall to a front side.

The first space, the fourth space, the fifth space, the sixth space and the seventh space are communicating with one another along the crosswise direction at a rear end part of each of the first space, the fourth space, the fifth space, the sixth space and the seventh space. Thereby, if water enters into any one of these spaces, this water flows in the rear end part of each of these spaces along the crosswise direction. Therefore, this water easily exits from the main body case without entering the output opening.

As a result, waterproofness can be improved because it is difficult for water splashing onto the main body case to reach the output opening.

According to an invention of claim 3, each part communicating along the crosswise direction of the first space, the fourth space, the fifth space, the sixth space and the seventh space is penetrating the main body case along the crosswise direction. Thereby, water entering the main body case from a front side flows in the each part communicating along the crosswise direction of these spaces along the crosswise direction and easily exits from the main body case without changing a flow direction of the water. Also, when water enters the main body case from the crosswise direction, this water flows in the each part communicating along the crosswise direction of these spaces along the crosswise direction and easily exits from the main body case without changing a flow direction of the water and without splashing to the output opening side at the rear main wall. Thereby, waterproofness can be improved because it is difficult for water splashing onto the main body case to reach the output opening.

According to an invention of claim 4, the front main wall, the left main wall and the right main wall are integrally molded with the main body case. Thereby, the number of components can be reduced.

According to an invention of claim 5, it is possible to flow water entering any one of the first and the fourth to the seventh spaces along the flat front surface of the rear main wall. Thereby, splashing of the water to the output opening side at the front surface of the rear main wall can be prevented. Therefore, waterproofness can be further improved.

According to an invention of claim 6, the rear surface convexly curved to a front side of the front main wall covers the output opening from a front side. Thereby, entering of a water droplet from a front side to the output opening can be prevented. Therefore, waterproofness can be further improved.

According to an invention of claim 7, each front tip part of the front main wall, the left main wall and the right main wall is extended to the neighborhood of the outer edge of the main body case. Thereby, it is possible to surely guide sound reflected to a front side at the rear main wall to a front side of the main body case. Therefore, sound volume of the notification device can be improved.

According to an invention of claim 10, the main body case includes the space for the wiring of the signal unit at a rear side of the main body case in the signal indicator lamp including the signal unit at least one of an upper side and a lower side of the main body case. Thereby, the whole signal indicator lamp can achieve a compact configuration by accommodating the wiring of the signal unit in the space.

DESCRIPTION OF EMBODIMENTS

Figure 1:
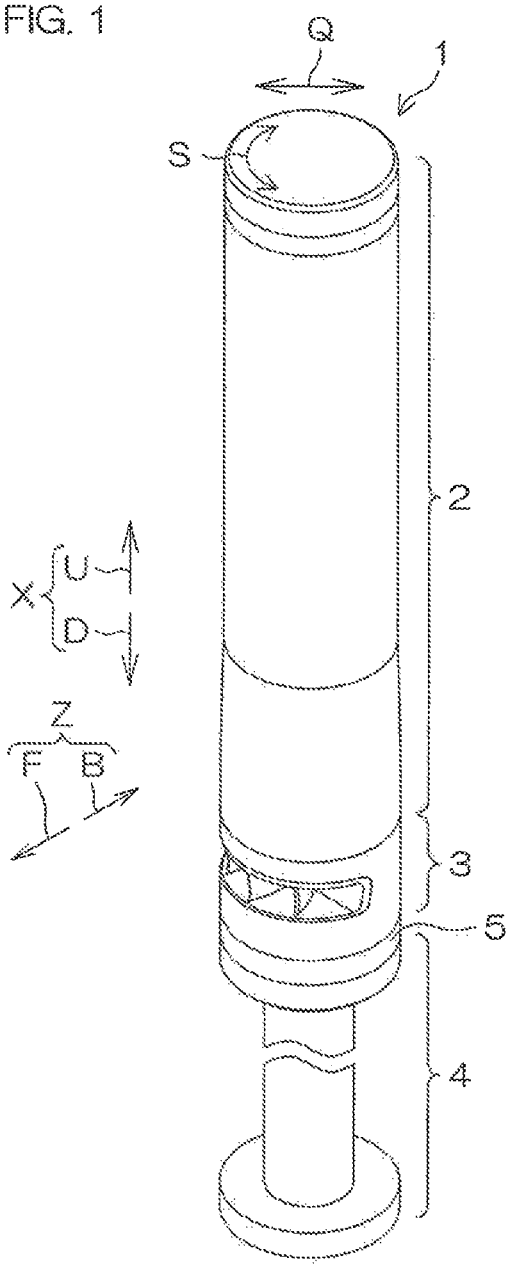
FIG. 1 is a perspective view of a signal indicator lamp 1 according to a preferred embodiment of this invention seen from an upper side.

Embodiments of this invention are explained by referring to figures in the following. FIG. 1 is a perspective view of a signal indicator lamp 1 according to a preferred embodiment of this invention seen from an upper side.

Referring to FIG. 1, the signal indicator lamp 1 is used in a manufacturing site of a factory etc. in order to notify a situation etc. of the manufacturing site to people. In the following explanation, a posture of the signal indicator lamp 1 is vertically long (erect) as an example.

The signal indicator lamp 1 includes a signal unit 2 for transmitting a predetermined visual signal like light etc. and an acoustic unit 3 for emitting sound as a notification device.

The signal indicator lamp 1 is mounted on a disk shape base 5 connected to an upper end of a columnar leg 4 extending in a vertical direction X. The acoustic unit 3 is connected to the base 5 from an upper side U. The signal unit 2 is connected to the acoustic unit 3 from the upper side U.

The signal unit 2 and the acoustic unit 3 in connected condition configure a cylindrical shape extending in the vertical direction X with approximately constant width (diameter) and being long in the vertical direction X. In the following, each of members configuring the signal indicator lamp 1 is explained by mainly using a radial direction Q and a peripheral direction S of this cylindrical shape and the above-mentioned vertical direction X. A diameter of an outer peripheral surface of the signal indicator lamp 1 explained in the following is approximate 40 mm to 60 mm.

Also, with respect to a term of "connect", connecting two members means detachably mounting a first member to a second member of the two members and simply putting the first member on the second member in this description.

Figure 2:
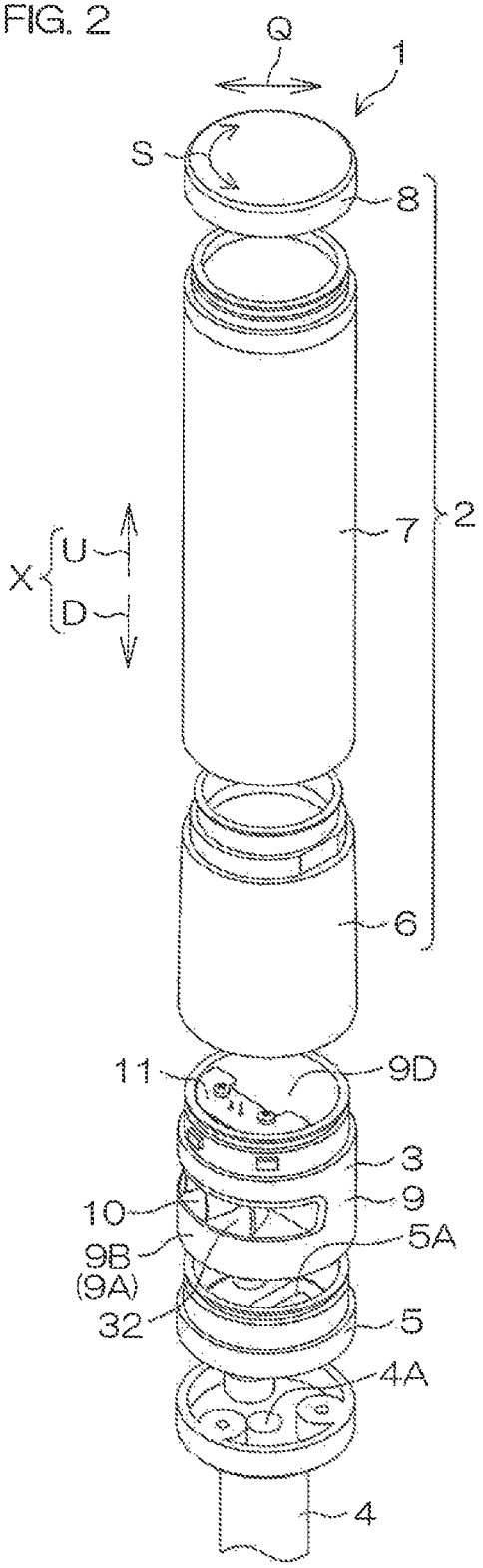
FIG. 2 is a disassembled perspective view of the signal indicator lamp 1.

FIG. 2 is a disassembled perspective view of the signal indicator lamp 1.

Referring to FIG. 2, the signal unit 2 includes a cylindrical body 6 and a cylindrical case 7 which having an axis extending in the vertical direction X, and a disk shape head cover 8. The case 7 is connected to the body 6 from the upper side U. The head cover 8 is connected to an upper end part of the case 7 from the upper side U. Thereby, the signal unit 2 is completed. The case 7 is transparent or translucent. A light emitting unit (not shown) is accommodated in the case 7.

This light emitting unit includes a mount substrate extending in the vertical direction X, a plurality of LEDs mounted on this mount substrate and lenses for example. Light from the LED penetrates the corresponding lens and the case 7, and is radiated around the signal unit 2. By lighting of the light emitting unit with a predetermined pattern, the signal unit 2 transmits a predetermined signal.

The acoustic unit 3 is a unit including a sound source therein and emitting various sound and voice signals. The acoustic unit 3 has a cylindrical shape having an axis extending in the vertical direction X. The acoustic unit 3 includes a cylindrical main body case 9 configuring an outline shape thereof. The main body case 9 is made of resin. An upper end part of the main body case 9 is connected to a lower end part of the signal unit 2 from a lower side D. Therefore, the signal unit 2 is placed at an upper side of the main body case 9. Also, the base 5 is connected to a lower end part of the main body case 9 from the lower side D.

An inner space 4A extending in the vertical direction X and exposed to the upper side U is formed in the leg 4. Also, a through hole 5A penetrating the base 5 in the vertical direction X is formed in the base 5. Cables (not shown) for supplying control signal and electric power to the signal unit 2 and the acoustic unit 3 is inserted in the inner space 4A and the through hole 5A. Control signal and electric power supplied by these cables are supplied to the signal unit 2 via an inner space 9D (described later) of the main body case 9.

Figure 3:
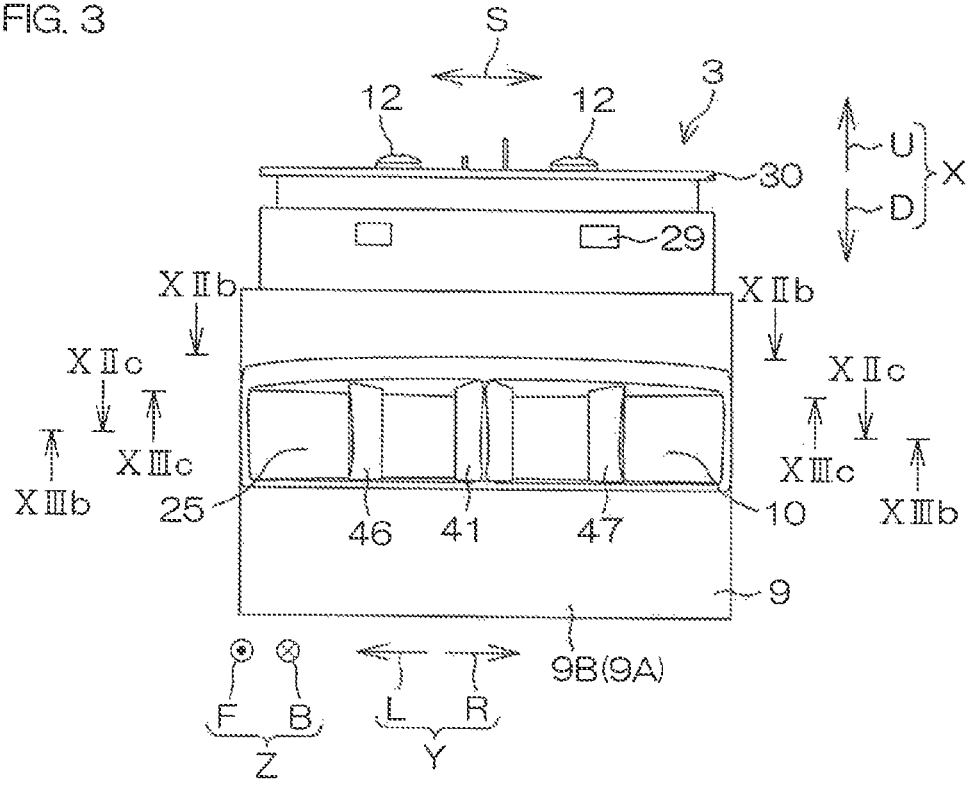
FIG. 3 is a front view of an acoustic unit 3 included in the signal indicator lamp 1.
Figure 4:
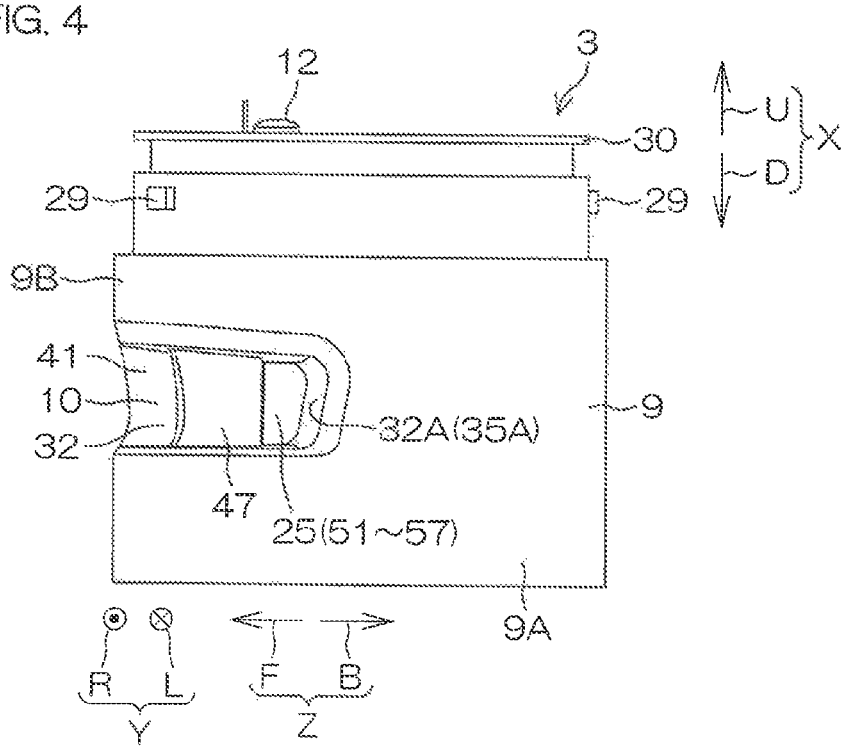
FIG. 4 is a right side view of the acoustic unit 3.

FIG. 3 is a front view of the acoustic unit 3. FIG. 4 is a right side view of the acoustic unit 3.

Referring to FIG. 3, the main body case 9 of the acoustic unit 3 has a cylindrical shape having an axis extending in the vertical direction X. An opening 10 having an approximately rectangular shape which is long in the peripheral direction S, is formed at an approximately central part of an outer peripheral surface 9A of the main body case 9 in the vertical direction X over an approximately half area thereof in the peripheral direction S. Referring to FIG. 3 and FIG. 4, a side where the opening 10 is formed in the main body case 9 is referred to as a front side F of the acoustic unit 3 and an opposite side to the front side F is referred to as a rear side B of the acoustic unit 3 in the following. A left side L and right side R of the acoustic unit 3 are defined when the acoustic unit 3 is seen from the front side F. A direction including the left side L and the right side R is referred to as a crosswise direction Y. A direction including the front side F and the rear side B is referred to as an anteroposterior direction Z.

Also, an area at the front side F formed with the opening 10 in the outer peripheral surface 9A is a front surface 9B of the main body case 9. An opening 25 as a part of the opening 10 penetrating the main body case 9 in the crosswise direction Y exists at the rear side B of the opening 10.

Figure 5:
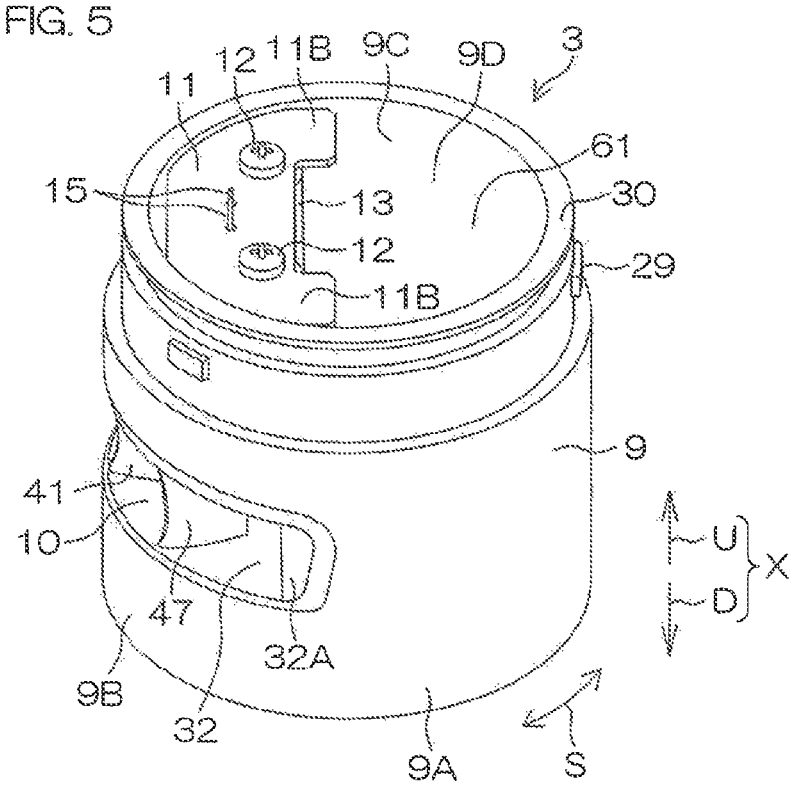
FIG. 5 is a perspective view of the acoustic unit 3 seen from a right-upper side.
Figure 6:
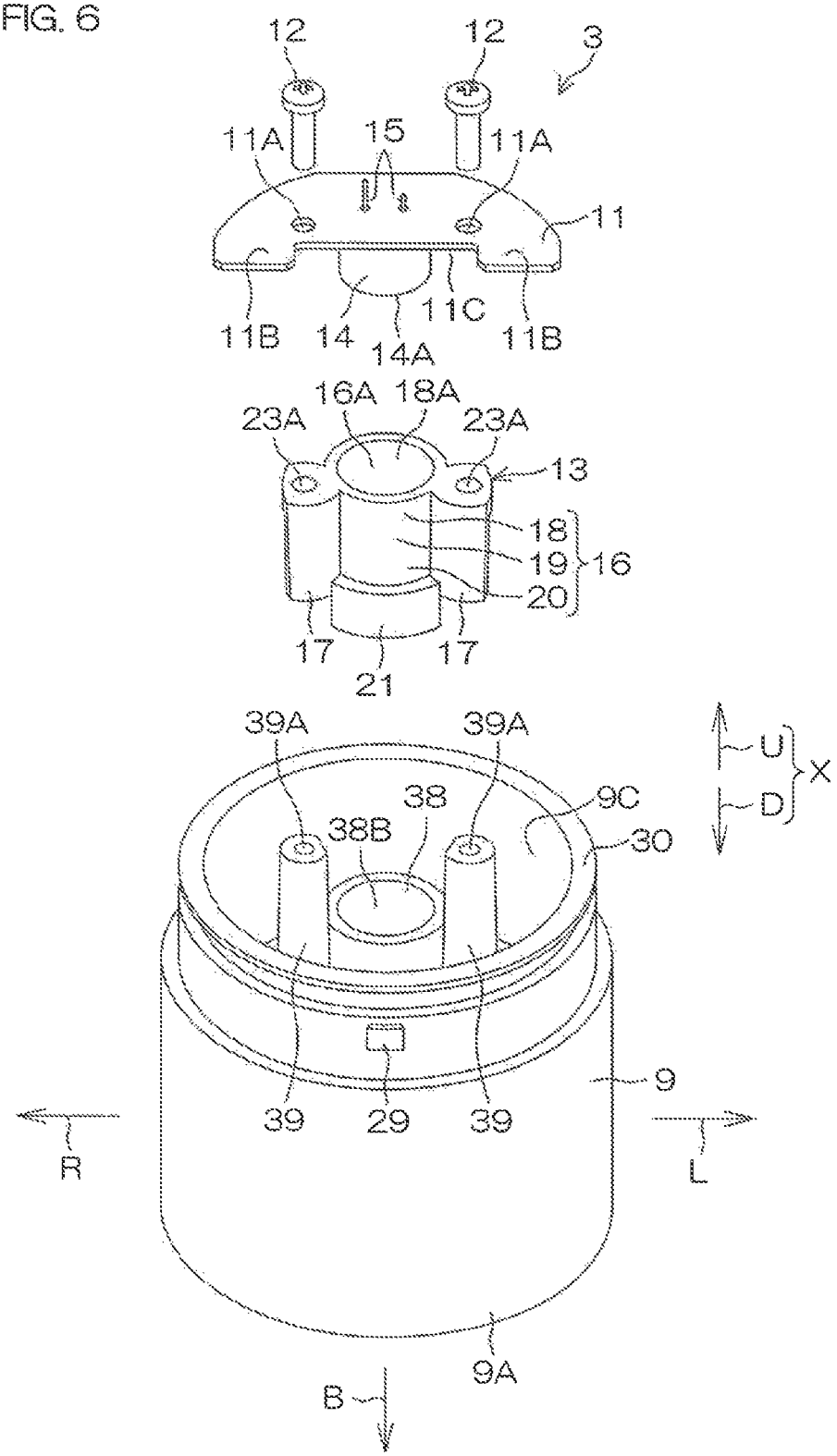
FIG. 6 is a disassembled perspective view of the acoustic unit 3 seen from a rear-upper side.

FIG. 5 is a perspective view of the acoustic unit 3 seen from a right-upper side. FIG. 6 is a disassembled perspective view of the acoustic unit 3.

Referring to FIG. 5 and FIG. 6, the acoustic unit 3 includes the main body case 9, a sound source mount substrate 11, bolts 12 and a sound source holder 13.

The sound source mount substrate 11 has an approximately semicircular shape seen from the vertical direction X and is thin in the vertical direction X. A circular through hole 11A is formed near both sides of an arc part of the sound source mount substrate 11 in a peripheral direction thereof, respectively. Each of the through holes 11A is penetrating the sound source mount substrate 11 in the vertical direction X. The arc part of the sound source mount substrate 11 has a shape along an inner peripheral surface 9C of the main body case 9. Both sides of the sound source mount substrate 11 function as grip parts 11B gripped when the sound source mount substrate 11 is mounted to the main body case 9. Assemblability of the sound source mount substrate 11 to the main body case 9 is improved by the grip part 11B.

A sound source 14 is mounted from the lower side D to an area between two through holes 11A at a lower surface 11C of the sound source mount substrate 11. Thereby, the sound source 14 is integrated with the sound source mount substrate 11. The sound source 14 is an approximately columnar buzzer having an axis extending in the vertical direction X. A lower surface of the sound source 14 is a sound emitting part 14A where sound generated by the sound source 14 is outputted. A wiring 15 connected to the sound source 14 is extending to the upper side U through the sound source mount substrate 11 and connected to the above-mentioned cable.

Each of the bolts 12 is inserted into each of the through hole 11A from the upper side U, respectively.

The sound source holder 13 is made of resin and includes a main body part 16 and a supporting part 17 integrally. The sound source holder 13 is mounted on the main body case 9. The sound source mount substrate 11 is placed on the sound source holder 13 and fixed to the main body case 9 by the bolts 12. The supporting part 17 contributes in order to fix the sound source holder 13 and the sound source mount substrate 11 to the main body case 9.

The main body part 16 accommodates the sound source 14 and forms a guide space 62 described later cooperatively with the main body case 9. The main body part 16 has an approximately cylindrical shape having an axis extending in the vertical direction X. An inner space 16A penetrating the main body part 16 in the vertical direction X is formed in the main body part 16. The main body part 16 includes a storage part 18, a first sound guiding pipe 19 and a first tilting pipe 20 in this order from the upper side U. Each of the storage part 18, the first sound guiding pipe 19 and the first tilting pipe 20 has an approximately cylindrical shape. The main body part 16 is configured by the storage part 18, the first sound guiding pipe 19 and the first tilting pipe 20 strung in the vertical direction X.

Figure 7A:
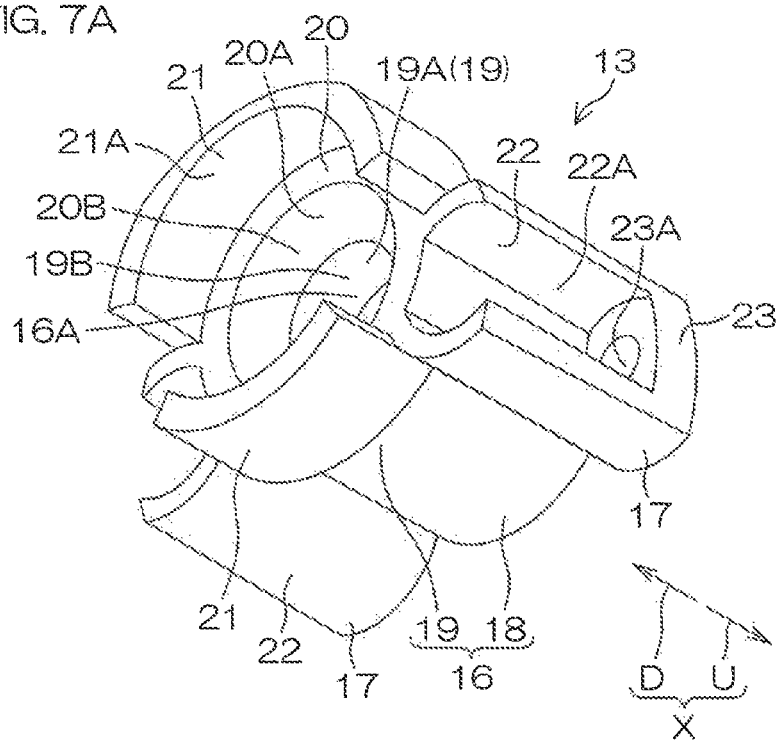
FIG. 7A is a perspective view of a sound source holder 13.
Figure 7B:
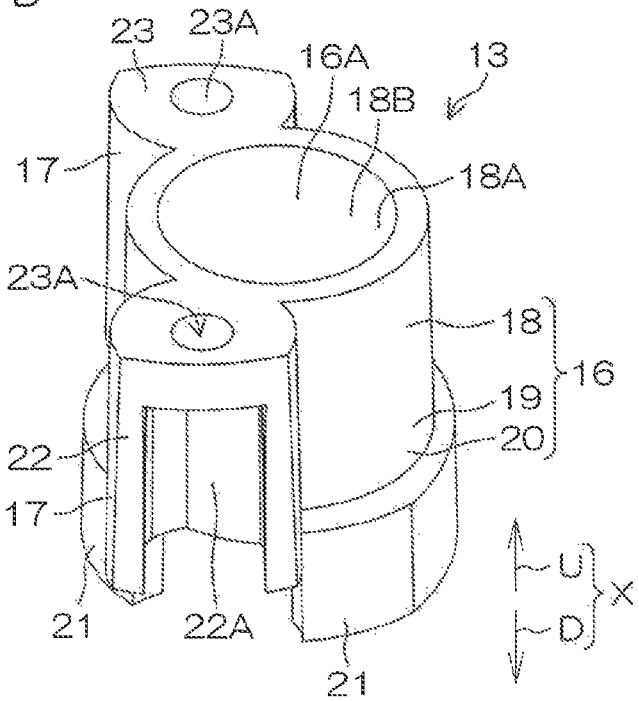
FIG. 7B is a perspective view of the sound source holder 13 seen from a different direction from that of FIG. 7A.
Figure 7C:
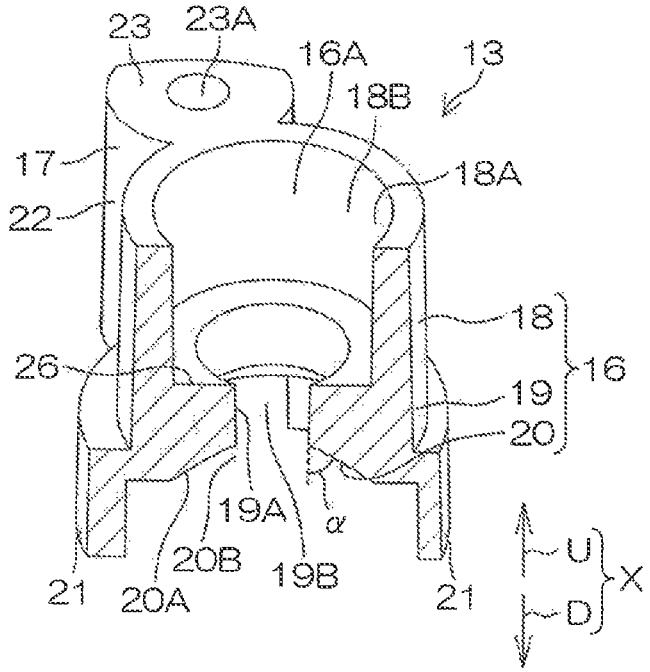
FIG. 7C is a partial perspective view of the sound source holder 13, showing a partial vertical section.
Figure 7D:
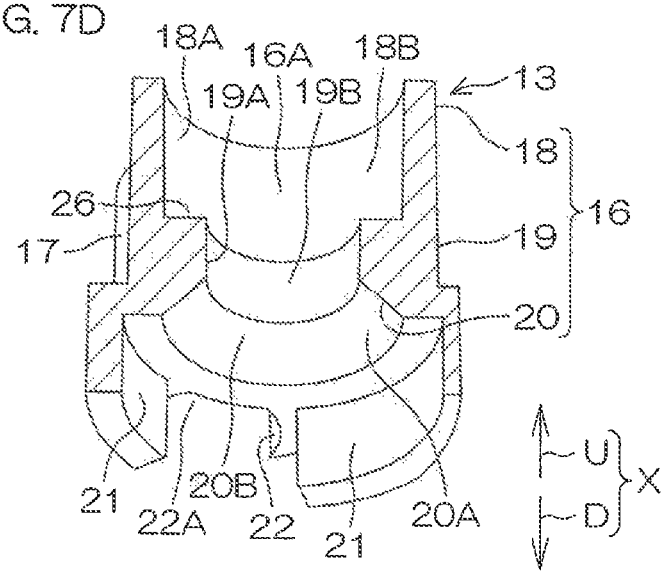
FIG. 7D is a partial perspective view of the sound source holder 13 seen from a different direction from that of FIG. 7C.

FIGS. 7A and 7B are perspective views of the sound source holder 13 seen from different directions. FIGS. 7C and 7D are partial perspective views of the sound source holder 13, showing a partial vertical section.

Referring to FIG. 7C and FIG. 7D, a space of the main body part 16 is surrounded by an inner peripheral surface 18A of the storage part 18 and the space is referred to as a storage space 18B. And another space of the main body part 16 is surrounded by an inner peripheral surface 19A of the first sound guiding pipe 19 and the space is referred to as a first sound guiding space part 19B. A still another space of the main body part 16 is surrounded by an inner peripheral surface 20A of the first tilting pipe 20 and the space is referred to as a first space part 20B.

The main body part 16 functions as a part of the space part which is necessary in order to improve sound volume. That is, an inner space 16A of the main body part 16 is configured by the storage space 18B, the first sound guiding space part 19B and the first space part 20B. The inner space 16A is radially-reduced by one step and configures the first sound guiding space part 19B at a lower end of the storage space 18B. The inner space 16A is radially-enlarged gradually to the lower side D at the first space part 20B.

Outer peripheral surfaces of the storage part 18, the first sound guiding pipe 19 and the first tilting pipe 20 are flush with one another. On the other hand, partial shapes of inner peripheral surfaces of the storage part 18, the first sound guiding pipe 19 and the first tilting pipe 20 are different with one another.

Referring to FIG. 6 and FIG. 7A to FIG. 7D, the storage part 18 accommodates the sound source 14 therein in condition that the sound source mount substrate 11 is mounted to the storage part 18. An inner peripheral surface 18A of the storage part 18 has a cylindrical shape. Size (diameter) of the inner peripheral surface 18A is approximately same as a diameter of the sound source 14 accommodated in the storage part 18. Inner height of the storage part 18 in the vertical direction X is approximately same as height of the sound source 14 accommodated. A center of the storage part 18 and a center of the sound emitting part 14A of the sound source 14 accommodated coincide approximately to each other in a radial direction of the storage part 18.

The first sound guiding pipe 19 is placed in communicating condition to the storage part 18 from the lower side D. The first sound guiding pipe 19 has a cylindrical shape having a constant diameter through a whole area in the vertical direction X. Also, a central position of the first sound guiding pipe 19 in a radial direction thereof and a central position of the storage part 18 in a radial direction thereof coincide approximately seen from the vertical direction X. That is, a central position of the sound source 14 and a central position of the first sound guiding pipe 19 coincide approximately in the radial direction. Also, the inner peripheral surface 19A of the first sound guiding pipe 19 is radially-smaller and shorter in the vertical direction X than the inner peripheral surface 18A of the storage part 18. Thereby, a step part 26 is formed between the storage part 18 and the first sound guiding pipe 19 (refer to FIG. 7C and FIG. 7D). A periphery of the sound source 14 around the sound emitting part 14A contacts directly to the step part 26 or contacts indirectly to the step part 26 via a water-proof packing (not shown) provided at the periphery. Thereby, sound blowed from the sound emitting part 14A of the sound source 14 is guided to the first sound guiding pipe 19.

The first tilting pipe 20 is positioned at a lower side of the first sound guiding pipe 19 in communicating condition with the first sound guiding pipe 19. The inner peripheral surface 20A of the first tilting pipe 20 has a conic shape which is radially-enlarged to the lower side D from a lower end of the inner peripheral surface 19A of the first sound guiding pipe 19. That is, the first tilting pipe 20 is connected to a lower end of the first sound guiding pipe 19 and enlarged to the lower side D at the inner peripheral surface 20A. Also, a central position of the first tilting pipe 20 in a radial direction thereof and a central position of the first sound guiding pipe 19 in a radial direction thereof coincide approximately to each other. That is, a central position of the sound source 14 and a central position of the first tilting pipe 20 coincide approximately to each other in the radial direction. In this connection, a tilt angle $\alpha$ of the inner peripheral surface 20A toward the vertical direction X is preferably approximately 45 degrees (refer to FIG. 7C).

The main body part 16 includes a pair of the fitting parts 21 integrally. Each of the fitting part 21 is fitted to a cylindrical pipe 38 (described later) of the main body case 9. Each of the fitting part 21 has an arc shape along an outer peripheral surface of a lower end part of the main body part 16 and is overhanging to the lower side D rather than the main body part 16. A pair of the fitting parts 21 are placed with an interval of approximately 180 degrees in a peripheral direction of the main body part 16. Also, a pair of the fitting parts 21 are estranged from each other so as to avoid a substrate holding part 39 (refer to FIG. 14) to which the supporting part 17 (described later) is mounted when these fitting parts 21 are fitted to the cylindrical pipe 38.

A pair of the supporting parts 17 are provided. The main body part 16 is sandwiched between these supporting parts 17. Each of the supporting parts 17 integrally includes a peripheral wall 22 extending in the vertical direction X and an end wall 23 connected to an upper end of the peripheral wall 22.

When the sound source holder 13 is mounted to the main body case 9, the peripheral wall 22 surrounds the substrate holding part 39 therein. A section of the peripheral wall 22 in a direction orthogonal to the vertical direction X has an approximate "C" shape opened to outside in a radial direction of the main body part 16. A space 22A surrounded by the peripheral wall 22 is exposed to the outside at a lower end thereof and also exposed to outside at the outside in a radial direction of the main body part 16.

The end wall 23 has a plate shape which is thin in the vertical direction X and is closing the space 22A from the upper side U. A circular through hole 23A penetrating the end wall 23 in the vertical direction X and communicating with the space 22A is formed in the end wall 23. When the sound source holder 13 is mounted to the main body case 9, the end wall 23 contacts a surface (not shown) of the uppermost part of the substrate holding part 39.

Each of the supporting parts 17 is positioned between a pair of the fitting parts 21 in a peripheral direction of the main body part 16. A lower end surface of the supporting part 17 and a lower end surface of the main body part 16 (other than the fitting part 21) are flush with each other.

Figure 8:
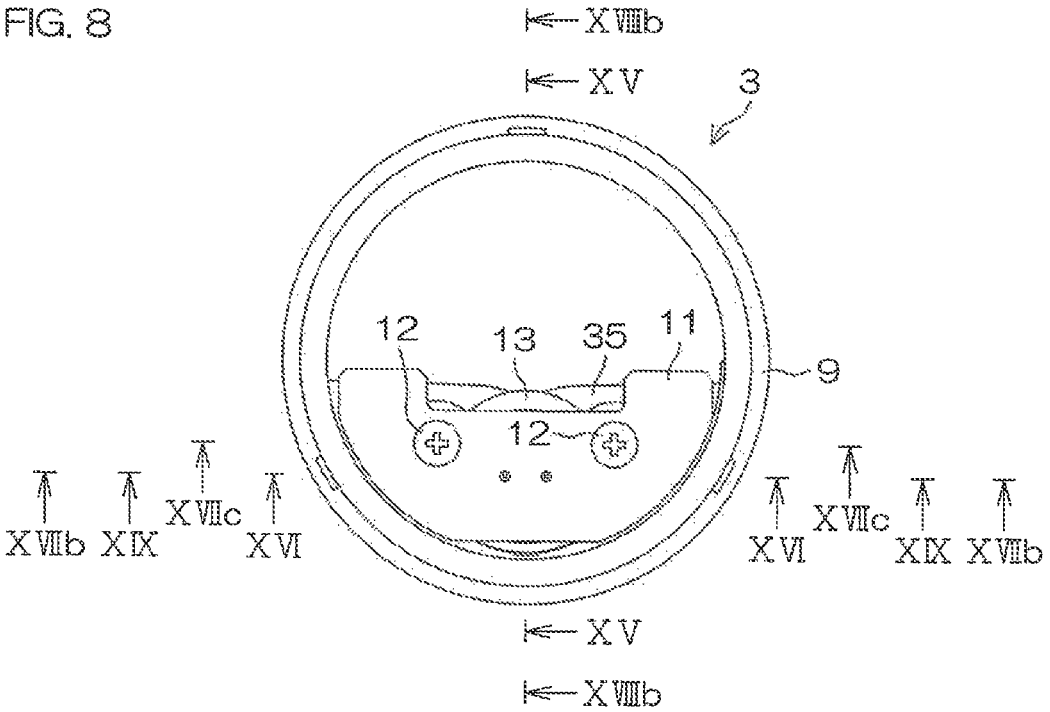
FIG. 8 is a plan view of the acoustic unit 3.
Figure 9:
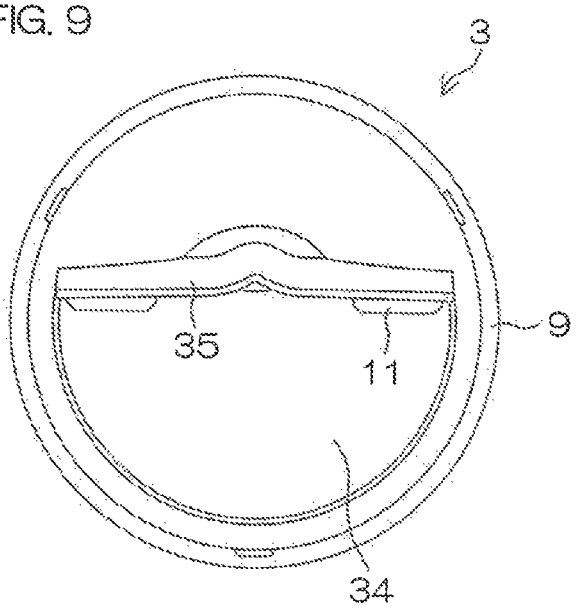
FIG. 9 is a bottom view of the acoustic unit 3.
Figure 10:
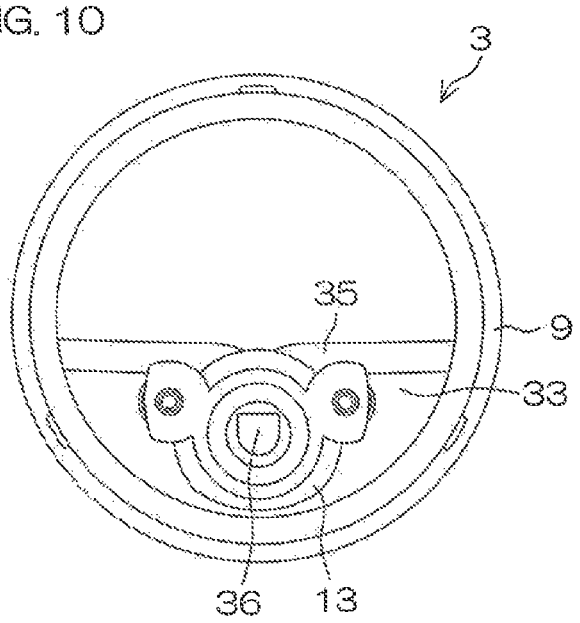
FIG. 10 is a plan view of the acoustic unit 3 in a condition that the sound source mount substrate 11 is detached therefrom.
Figure 11:
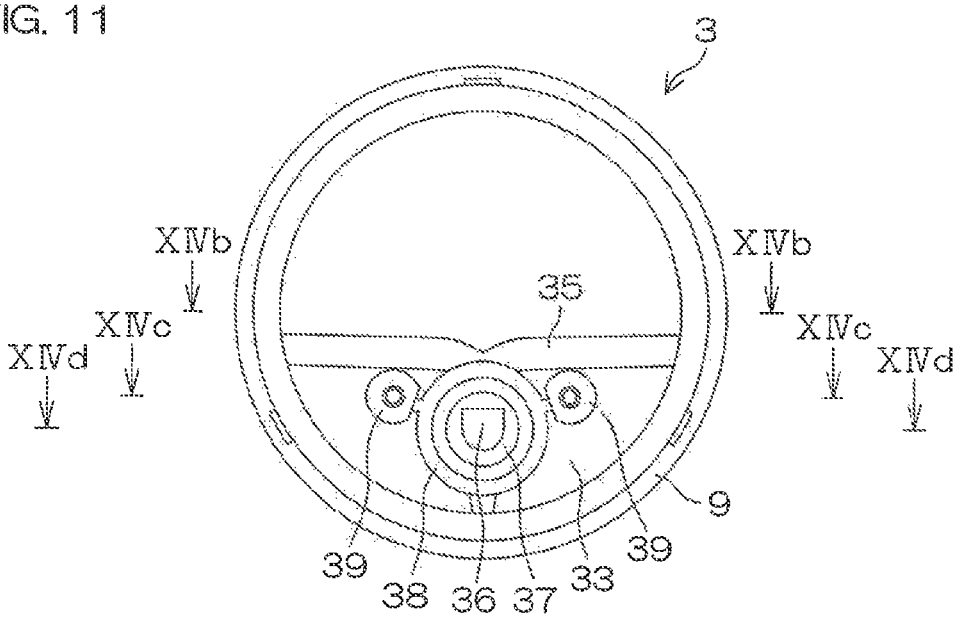
FIG. 11 is a plan view of the main body case 9 from which the sound source mount substrate 11 and the sound source holder 13 are detached.

FIG. 8 is a plan view of the acoustic unit 3 in assembled condition. FIG. 9 is a bottom view of the acoustic unit 3 in assembled condition. Condition of the completed acoustic unit 3 from which the sound source mount substrate 11 and the bolts 12 are removed is shown in FIG. 10. FIG. 10 shows condition that the sound source holder 13 is exposed to the upper side U. Condition of the completed acoustic unit 3 from which the sound source mount substrate 11, the bolts 12 and the sound source holder 13 are removed is shown in FIG. 11. FIG. 11 shows condition that the main body case 9 exists alone.

Figure 12A:
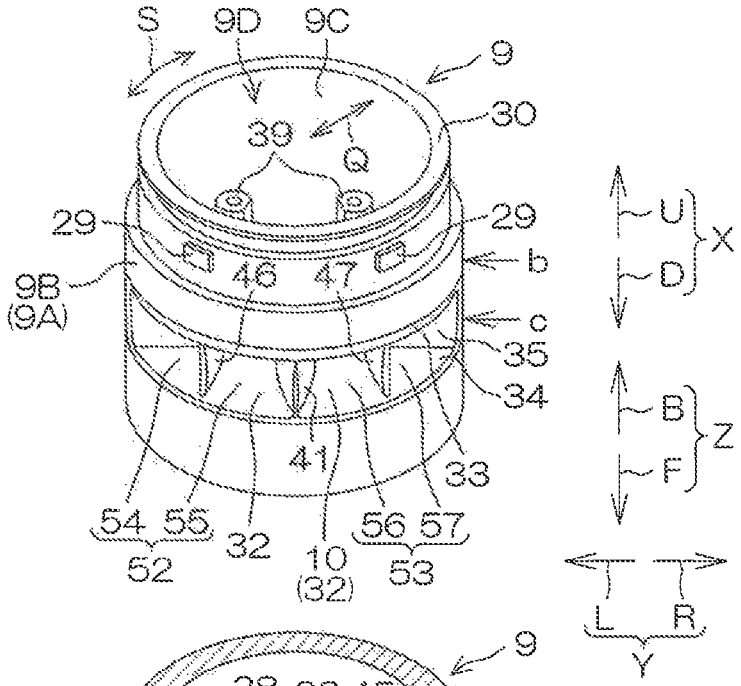
FIG. 12 (*a*) is a perspective view of the main body case 9 seen from a front-upper side, FIG. 12 (*b*) is a perspective view showing a section (a section at a line XIIb-XIIb of FIG. 3) at a position indicated by an arrow b of FIG. 12 (*a*), FIG. 12 (*c*) is a perspective view showing a section (a section at a line XIIc-XIIc of FIG. 3) at a position indicated by an arrow c of FIG. 12 (*a*).
Figure 12B:
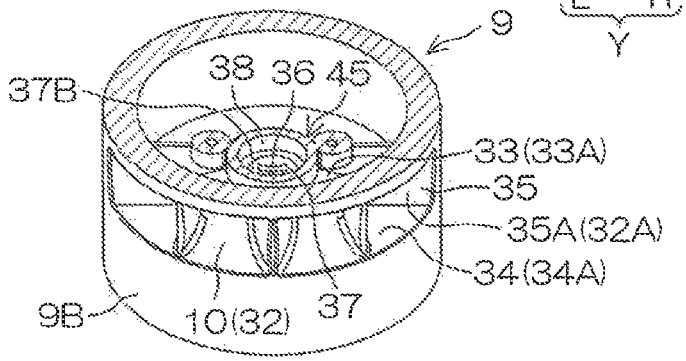
Figure 12C:
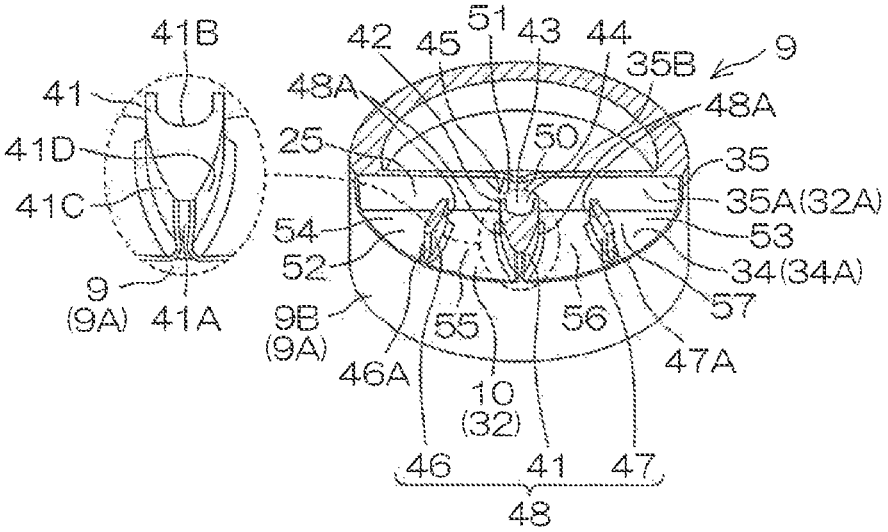
Figure 13A:
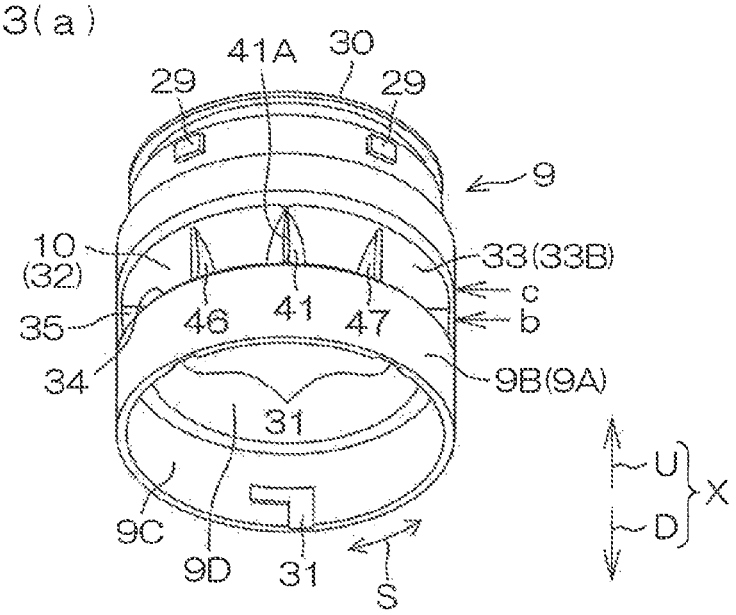
FIG. 13 (*a*) is a perspective view of the main body case 9 seen from a front-lower side, FIG. 13 (*b*) is a perspective view showing a section (a section at a line of FIG. 3) at a position indicated by an arrow b of FIG. 13 (*a*), FIG. 13 (*c*) is a perspective view showing a section (a section at a line XIIIc-XIIIc of FIG. 3) at a position indicated by an arrow c of FIG. 13 (*a*).
Figure 13B:
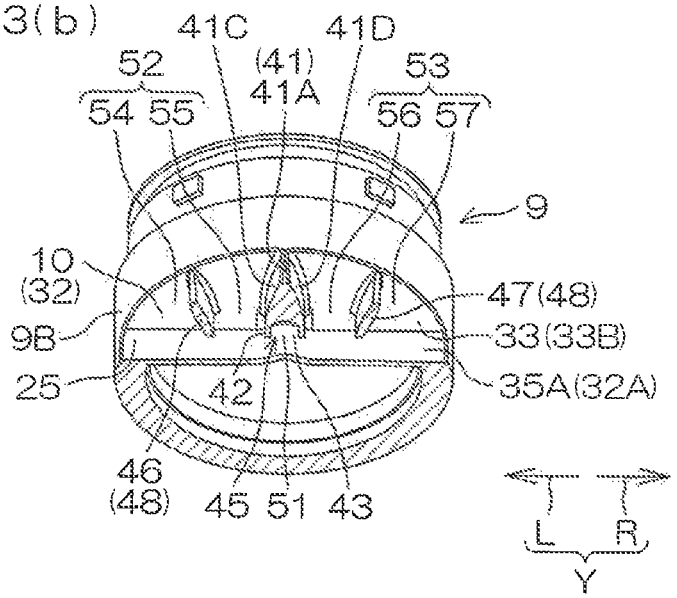
Figure 13C:
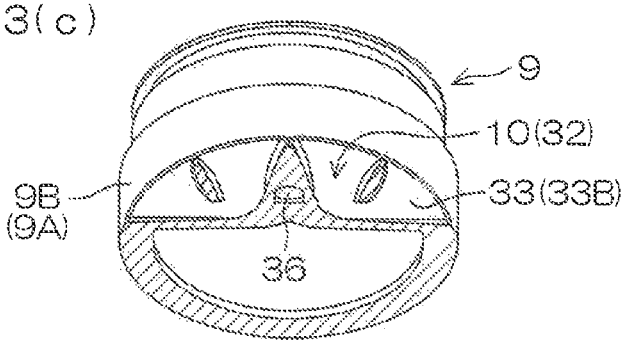
Figure 14A:
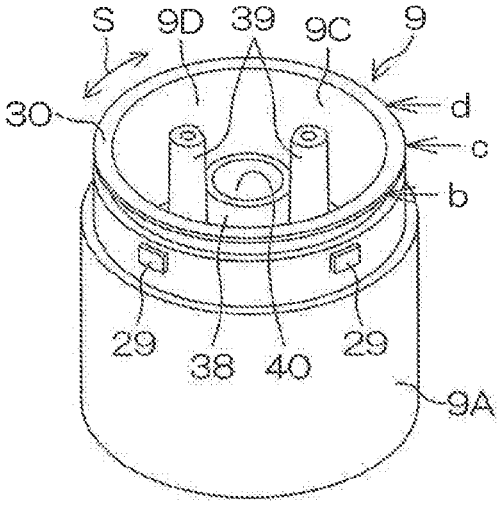
FIG. 14 (*a*) is a perspective view of the acoustic unit 3 seen from a rear-upper side, FIG. 14 (*b*) is a perspective view showing a section (a section at a line XIVb-XIVb of FIG. 11) at a position indicated by an arrow b of FIG. 14 (*a*), FIG. 14 (*c*) is a perspective view showing a section (a section at a line XIVc-XIVc of FIG. 11) at a position indicated by an arrow c of FIG. 14 (*a*), FIG. 14 (*d*) is a perspective view showing a section (a section at a line XIVd-XIVd of FIG. 11) at a position indicated by an arrow d of FIG. 14 (*a*).
Figure 14B:
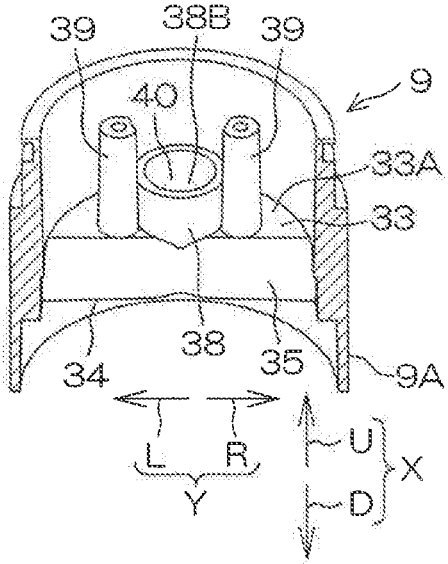
Figure 14C:
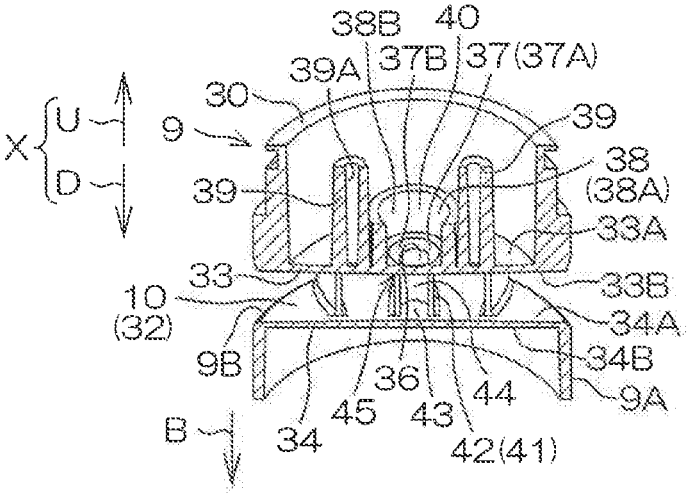
Figure 14D:
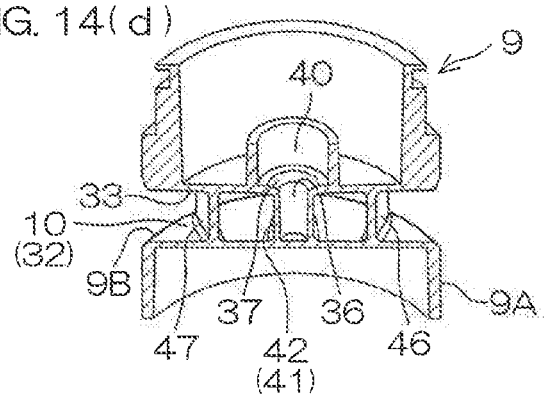

FIG. 12 is a perspective view of the main body case 9 seen from a front-upper side. FIG. 12 (*a*) shows an entire structure of the main body case 9. FIGS. 12 (*b*) and (*c*) are perspective views showing sections indicated by arrows b and c of FIG. 12 (*a*), respectively. In this connection, FIG. 12 (*c*) shows a part surrounded by a circle of broken line in enlarged condition. FIG. 13 is a perspective view of the main body case 9 seen from a front-lower side. FIG. 13 (*a*) shows an entire structure of the main body case 9. FIGS. 13 (*b*) and (*c*) are perspective views showing sections indicated by arrows b and c of FIG. 13 (*a*), respectively. FIG. 14 is a perspective view of the acoustic unit 3 seen from a rear-upper side. FIG. 14 (*a*) shows an entire structure of the main body case 9. FIGS. 14 (*b*), (*c*) and (*d*) are perspective views showing sections indicated by arrows b, c and d of FIG. 14 (*a*), respectively.

Referring to FIG. 12 to FIG. 14, an upper end part of the outer peripheral surface 9A is radially-reduced by two steps to the upper side U. A plurality of projections 29 projecting to the outside of the radial direction Q are formed with an interval in the peripheral direction S in the upper end part. These projections 29 are fitted to a groove of a lower end part of the signal unit 2 when an upper end part of the main body case 9 is connected to a lower end part of the signal unit 2 from the lower side D. A flange part 30 is formed at an upper end of the outer peripheral surface 9A. The flange part 30 is overhanging to the outside of the radial direction Q through a whole area in the peripheral direction S.

Also, a groove 31 having an "L" shape is formed in a lower end part of the inner peripheral surface 9C of the main body case 9. The groove 31 is extending to the upper side U and then bent to extend in the peripheral direction S. Also, a plurality of the grooves 31 are formed with an interval in the peripheral direction S. When the base 5 is connected to a lower end part of the main body case 9 from the lower side D, each of projections of the base 5 is fitted into each of the grooves 31, respectively.

A recess part 32 is formed in an approximately central part in the vertical direction X of the main body case 9. The recess part 32 is recessed to the rear side B from the opening 10 of the front surface 9B the main body case 9. The recess part 32 is a space having a semicircular shape bulging to the front side F seen from the vertical direction X. The recess part 32 has predetermined width in the vertical direction X so as to form an upper surface and a lower surface.

In connection with the recess part 32, the main body case 9 integrally includes an upper main wall 33 extending longitudinally and laterally, a lower main wall 34 extending longitudinally and laterally and a rear main wall 35 extending vertically and laterally. The lower main wall 34 is opposing to the upper main wall 33 from the lower side D. The rear main wall 35 is bridged between a rear end of the upper main wall 33 and a rear end of the lower main wall 34.

Each of the upper main wall 33 and the lower main wall 34 has a plate shape which is thin vertically and is formed in an approximately semicircular shape bulging to the front side F seen from the vertical direction X. An arc part of each of the upper main wall 33 and the lower main wall 34 coincides to the outer peripheral surface 9A (the front surface 9B). An upper surface 33A and a lower surface 33B of the upper main wall 33 are flat longitudinally and laterally. The lower surface 33B forms an upper surface of the recess part 32. The upper surface 34A and the lower surface 34B of the lower main wall 34 are flat longitudinally and laterally. The upper surface 34A forms a lower surface of the recess part 32. In this connection, the upper surface and the lower surface of the recess part 32 may be parallel to each other. Also, an interval between the upper surface and the lower surface in the vertical direction X may be widened slightly as approaching to the opening 10.

Also, a lower opening 36 is formed at an approximate center of the upper main wall 33 in the crosswise direction Y. The lower opening 36 is penetrating the upper main wall 33 vertically. The lower opening 36 has a semicircular shape bulging to the front side F seen from the vertical direction X.

Referring to FIG. 14 (*c*), a second tilting pipe 37, a cylindrical pipe 38 and a substrate holding part 39 are integrally provided in the upper surface 33A of the upper main wall 33.

The second tilting pipe 37 has a cylindrical shape extending to the upper side U from the upper surface 33A. The second tilting pipe 37 is surrounding the lower opening 36. An inner peripheral surface 37A of the second tilting pipe 37 has a conic shape which is radially-reduced to the lower side D. The lower opening 36 is surrounded and rimmed by a lower end of the inner peripheral surface 37A. That is, the inner peripheral surface 37A is narrowing to the lower opening 36. A tilt angle β of the inner peripheral surface 37A toward the vertical direction X is preferably approximately 30 degrees (refer to FIG. 15 described later).

The cylindrical pipe 38 is extended from the second tilting pipe 37 and has a cylindrical shape surrounding an upper end of the second tilting pipe 37 and extending to the upper side U. The second tilting pipe 37 is positioned at an approximate center of the cylindrical pipe 38 seen from the upper side U. An inner peripheral surface 38A of the cylindrical pipe 38 has a cylindrical shape having a constant diameter through a whole area in the vertical direction X and being radially-larger than the inner peripheral surface 37A of the second tilting pipe 37.

A space surrounded by the inner peripheral surface 38A in the main body case 9 is a second space part 38B. Also, a space surrounded by the inner peripheral surface 37A is a third space part 37B. The third space part 37B is communicating with the second space part 38B from the lower side D. Also, an upper end of the second space part 38B is an upper opening 40. The second space part 38B is exposed to the upper side U from the upper opening 40. The cylindrical pipe 38 is extending to the lower side D from the upper opening 40. The lower opening 36 is provided under the second space part 38B. Also, the lower opening 36 is communicating with the third space part 37B from the lower side D. The lower opening 36 is narrower (smaller seen from the vertical direction X) than the upper opening 40.

A pair of the substrate holding parts 39 are provided laterally so as to sandwich the cylindrical pipe 38 from the crosswise direction Y. Also, the substrate holding part 39 is a columnar boss extending to the upper side U from the upper surface 33A. An upper end of each of the substrate holding parts 39 is positioned between an upper end of the cylindrical pipe 38 and the flange part 30 seen from the vertical direction X. A screw hole 39A extending to the lower side D is formed at an upper end surface of each of the substrate holding parts 39.

Referring to FIG. 12 (*c*), the rear main wall 35 has a plate shape which is thin longitudinally and is formed in a rectangular band shape which is long in the crosswise direction Y seen from the front side F. A longitudinal dimension of the rear main wall 35 is approximately same as a diameter of the main body case 9. A front surface 35A and a rear surface 35B of the rear main wall 35 are flat vertically and laterally. The front surface 35A configures a back surface 32A extending vertically and laterally at a rear end of the recess part 32. Strictly, an approximately central part in the crosswise direction Y of the rear main wall 35 is protruding to the front side F. Therefore, a projection part 50 protruding to the front side F is provided in the front surface 35A (the back surface 32A of the recess part 32). Also, a part of the rear surface 35B which is at a same position as the projection part 50 in the crosswise direction Y is recessed to the front side F. In this connection, the front surface 35A and the rear surface 35B may be extending along the vertical direction X accurately or may be inclined slightly toward the vertical direction X. In this embodiment, the front surface 35A and the rear surface 35B are inclined to a front-lower side (refer to FIG. 4). The front surface 35A is inclined to the front-lower side, that is, a part in the lower side D of the front surface 35A is protruding to the front side F. Thereby, sound outputted from the upper side U via the lower opening 36 is radiated to the front side F.

As described above, the inner space 9D of the main body case 9 has an approximately cylindrical shape having an axis along the vertical direction X at almost whole areas in the vertical direction X thereof. But, the inner space 9D has a semicircular shape bulging to the rear side B seen from the vertical direction X at a position (an approximate center in the vertical direction X) where the recess part 32 is provided.

Referring to FIG. 12 (*c*) and FIG. 13 (*b*), the main body case 9 includes a front main wall 41 at a central part in the crosswise direction Y in the recess part 32. The front main wall 41 has a plate shape which is thin in the crosswise direction Y and getting thin gradually toward the front side F. Also, the front main wall 41 is bridged between the upper main wall 33 and the lower main wall 34. A front tip part 41A of the front main wall 41 is extended to the neighborhood of the outer peripheral surface 9A (the neighborhood of an outer edge of the main body case 9). A rear surface 41B of the front main wall 41 is convexly curved to the front side F seen from the vertical direction X.

A part of the front main wall 41 where the rear surface 41B is formed, configures a second sound guiding pipe 42 extending in the vertical direction X. A rear part of the second sound guiding pipe 42 is cut away vertically. A part cut away in the second sound guiding pipe 42 configures an output opening 43. The front main wall 41 is placed so as to extend to the front side F from the output opening 43.

Also, the output opening 43 is positioned to the front side F from the back surface 32A of the recess part 32 and opposing to the back surface 32A from the front side F. Therefore, the rear main wall 35 is opposing to a side of the output opening 43 of the front main wall 41 with an interval from the rear side B. Also, the output opening 43 and the projection part 50 of the rear main wall 35 are at same position in the crosswise direction Y. The projection part 50 is opposing to the output opening 43 with an interval from the rear side B.

Referring to FIG. 14 (*c*), a space surrounded by the second sound guiding pipe 42 is a second sound guiding space part 44. The second sound guiding space part 44 is exposed to the rear side B by the output opening 43. The second sound guiding space part 44 is positioned under the lower opening 36 and communicating the lower opening 36 and the output opening 43 with each other. Also, the second sound guiding space part 44 is communicating with the third space part 37B from the lower side D via the lower opening 36.

Here, a guide space forming member 45 is configured by the cylindrical pipe 38, the second sound guiding pipe 42 and the second tilting pipe 37 mentioned above. That is, the guide space forming member 45 is integrated with the main body case 9. Also, the guide space forming member 45 includes the upper opening 40, the second space part 38B, the lower opening 36, the third space part 37B and the second sound guiding space part 44. The upper opening 40, the second space part 38B, the lower opening 36, the third space part 37B and the second sound guiding space part 44 function as a guide space 62 (described later) by the guide space forming member 45.

Referring to FIG. 12 (*c*) and FIG. 13 (*b*), a space surrounded by the front main wall 41, the rear main wall 35, the upper surface 34A of the lower main wall 34 and an area of the lower surface 33B of the upper main wall 33 to the rear side B from the lower opening 36, is referred to as a first space 51. A space surrounded by a left surface 41C of the front main wall 41, the rear main wall 35, the upper main wall 33 and the lower main wall 34 is referred to as a second space 52. Also, a space surrounded by a right surface 41D of the front main wall 41, the rear main wall 35, the upper main wall 33 and the lower main wall 34 is referred to as a third space 53. As mentioned above, the rear main wall 35 is spaced from a side of the output opening 43 of the front main wall 41. Accordingly, the first space 51, the second space 52 and the third space 53 are communicating with one other along the crosswise direction Y at a rear end part of each of these spaces.

The main body case 9 further includes a left main wall 46 and a right main wall 47 in the recess part 32. The left main wall 46 is placed to the left side L with respect to the front main wall 41 with an interval. Also, the left main wall 46 is placed to the front side F with respect to the rear main wall 35 with an interval. The right main wall 47 is placed to the right side R with respect to the front main wall 41 with an interval. Also, the right main wall 47 is placed to the front side F with respect to the rear main wall 35 with an interval. Each of the left main wall 46 and the right main wall 47 has a plate shape which is thin in the crosswise direction Y and is bridged between the upper main wall 33 and the lower main wall 34. Also, the left main wall 46 and the right main wall 47 are getting thin gradually toward both of the front side F and the rear side B.

Strictly, as shown in FIG. 12 (*c*), the left main wall 46 is extending to a left front side along the radial direction Q of the main body case 9 seen from the vertical direction X. The right main wall 47 is extending to a right front side along the radial direction Q. A front tip part 46A of the left main wall 46 and a front tip part 47A of the right main wall 47 are extended to the neighborhood of the outer edge of the main body case 9, similarly to the front tip part 41A of the front main wall 41.

The left main wall 46 is dividing the second space 52 into a fourth space 54 on the left side L and a fifth space 55 on the right side R. The right main wall 47 is dividing the third space 53 into a sixth space 56 on the left side L and a seventh space 57 on the right side R. The front main wall 41, the left main wall 46 and the right main wall 47 are placed to the front side F with respect to the rear main wall 35 with an interval. Therefore, the first space 51, the fourth space 54, the fifth space 55, the sixth space 56 and the seventh space 57 are communicating with one another along the crosswise direction Y at a rear end part of each of the first space 51, the fourth space 54, the fifth space 55, the sixth space 56 and the seventh space 57. Also, each part communicating along the crosswise direction Y of the first space 51, the fourth space 54, the fifth space 55, the sixth space 56 and the seventh space 57 is penetrating the main body case 9 along the crosswise direction Y as the opening 25 mentioned above.

Each of the front main wall 41, the left main wall 46 and the right main wall 47 is generically named as a guide member 48. A plurality of the guide members 48 are provided with an lateral interval in the recess part 32. Each of the guide members 48 is getting thin gradually toward the front side F mentioned above. Therefore, opposing surfaces 48A of the guide members 48 neighboring laterally are estranged with each other in a trumpet shape so as to draw an exponential curve toward the front side F seen from the vertical direction X. In this connection, the left surface 41C and the right surface 41D of the front main wall 41 are left-and-right pair of opposing surfaces 48A of the front main wall 41.

Also, the front main wall 41, the left main wall 46 and the right main wall 47 are integrally molded with the main body case 9. Thereby, the number of components can be reduced.

Figure 15:
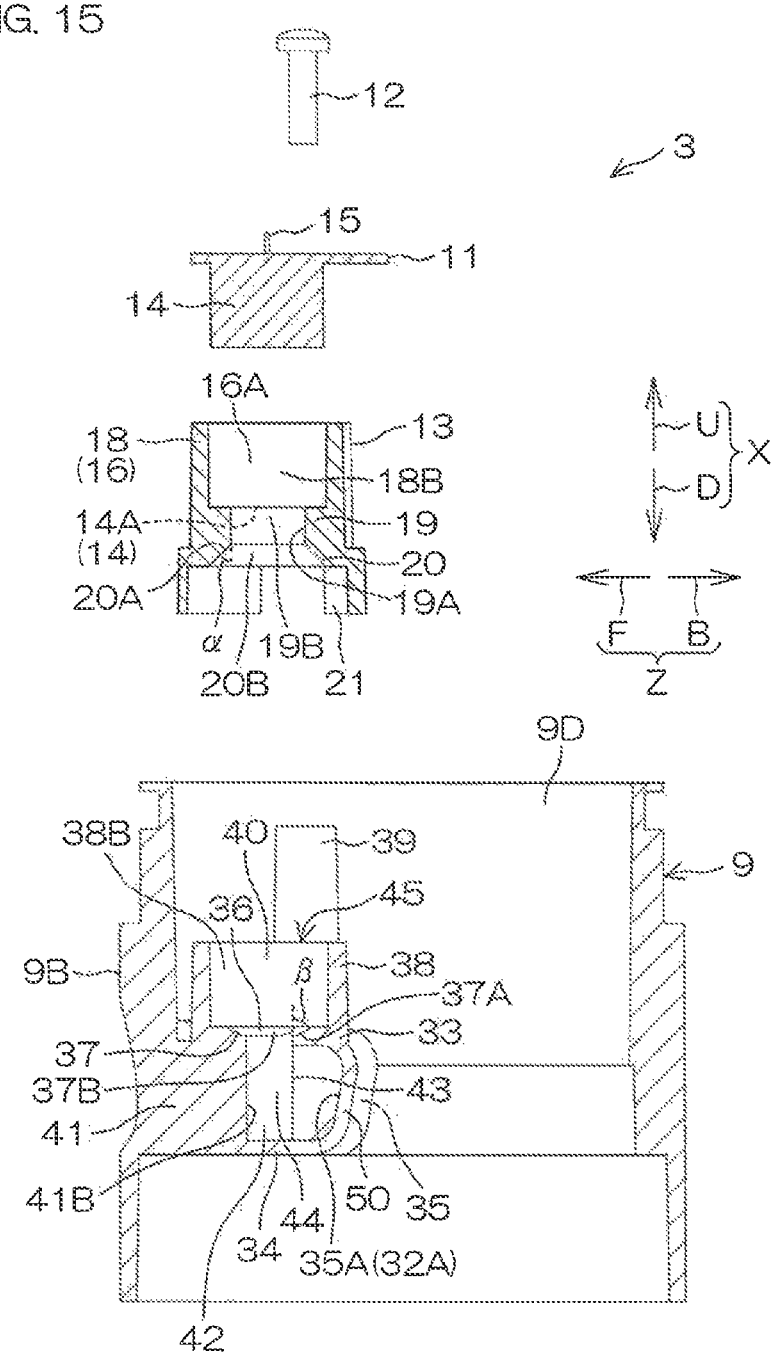
FIG. 15 is a XV-XV arrow sectional view of FIG. 8, showing a condition that each of parts is showed separately.
Figure 16:
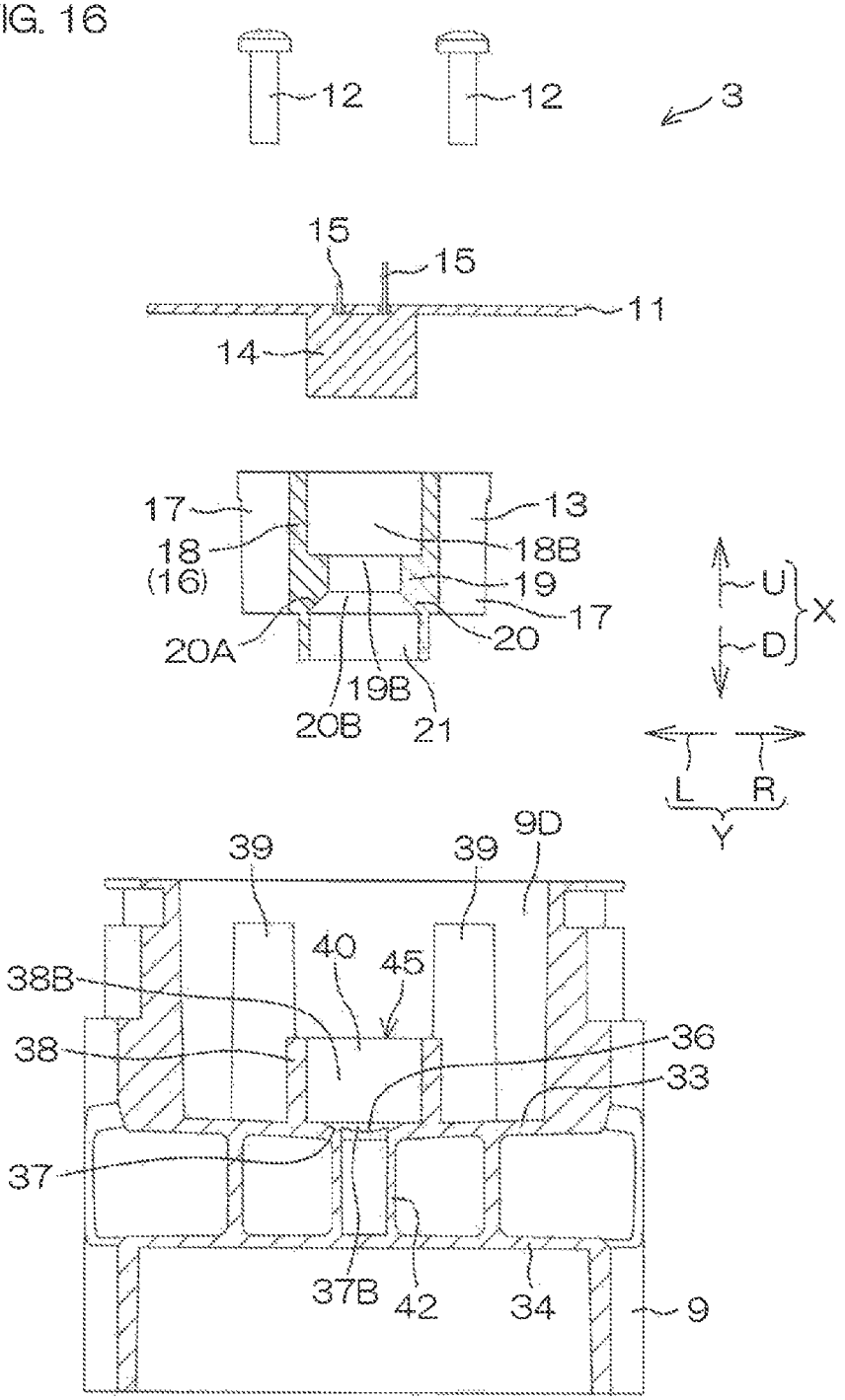
FIG. 16 is a XVI-XVI arrow sectional view of FIG. 8, showing a condition that each of parts is showed separately.
Figure 17A:
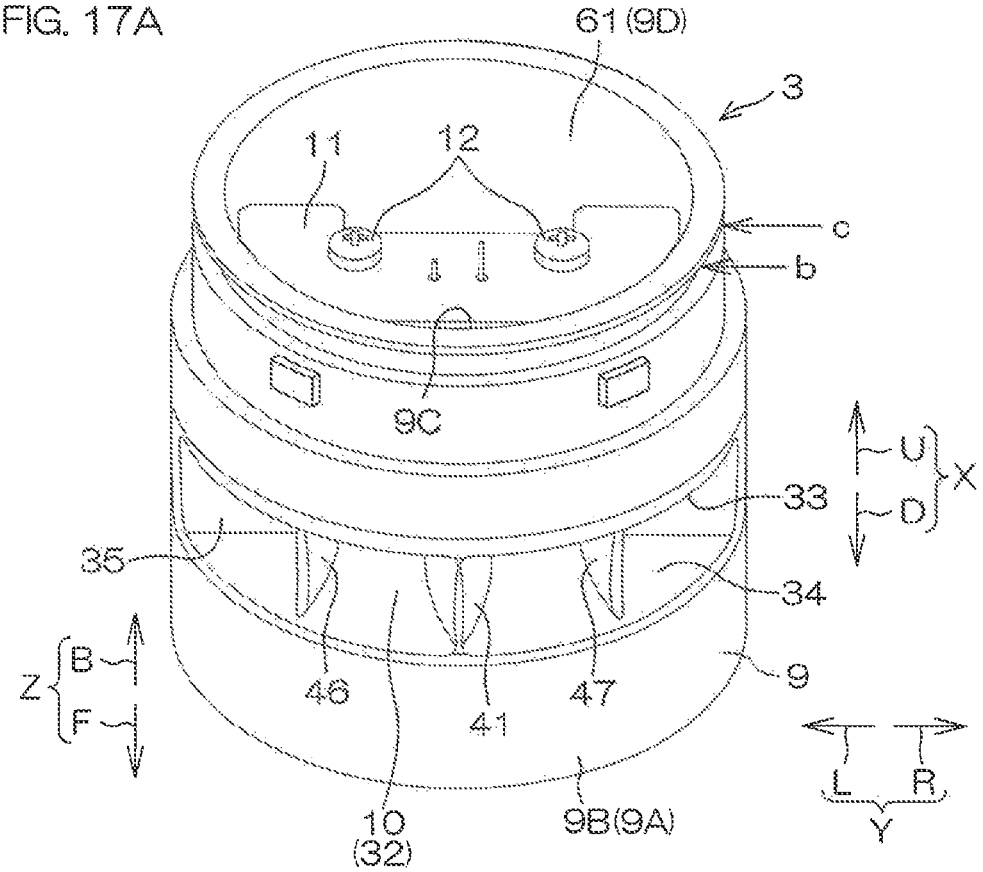
FIG. 17A is a perspective view of the acoustic unit 3 seen from a front-upper side.

FIG. 15 is a XV-XV arrow sectional view of FIG. 8, showing condition that each of parts is showed separately. FIG. 16 is a XVI-XVI arrow sectional view of FIG. 8, showing condition that each of parts is showed separately. FIG. 17A is a perspective view of the acoustic unit 3 seen from a front-upper side, FIG. 17B and FIG. 17C are perspective views showing sections at positions indicated by arrows b and c of FIG. 17A, respectively.

Referring to FIG. 15, FIG. 16 and FIG. 17A to FIG. 17C, assembling the acoustic unit 3 is explained.

At first, the sound source holder 13 is inserted into the inner space 9D of the main body case 9 from the upper side U and fitted to the cylindrical pipe 38 and the substrate holding part 39 of the main body case 9 so as to cover them from the upper side U.

Figure 17B:
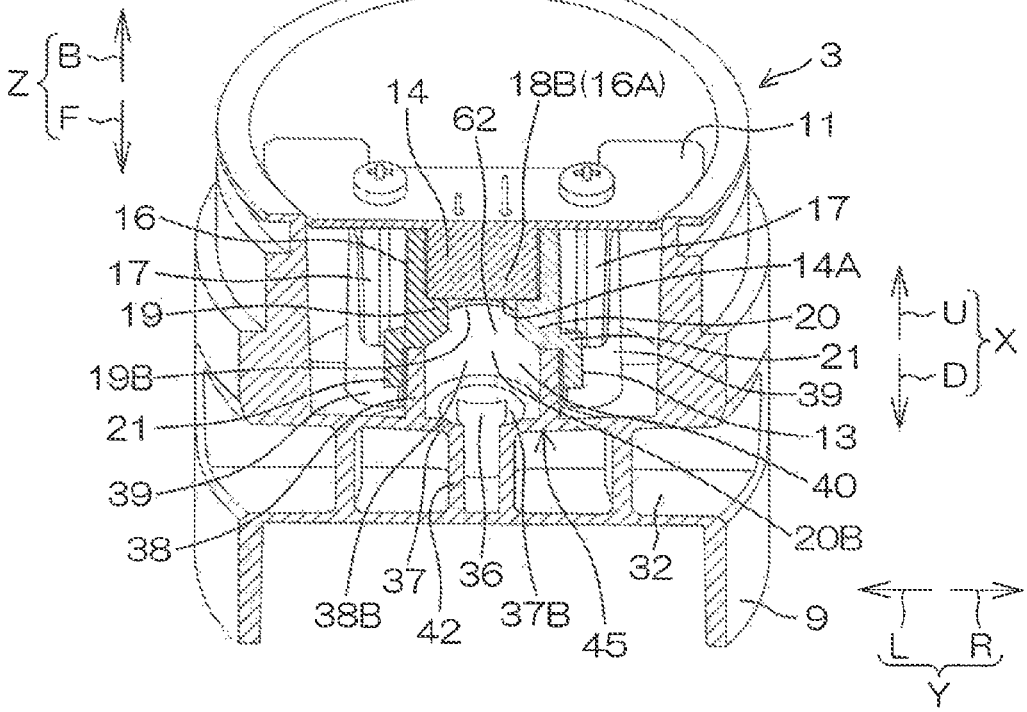
FIG. 17B is a perspective view showing a section (a section at a line XVIIb-XVIIb of FIG. 8) at a position indicated by an arrow b of FIG. 17A.
Figure 17C:
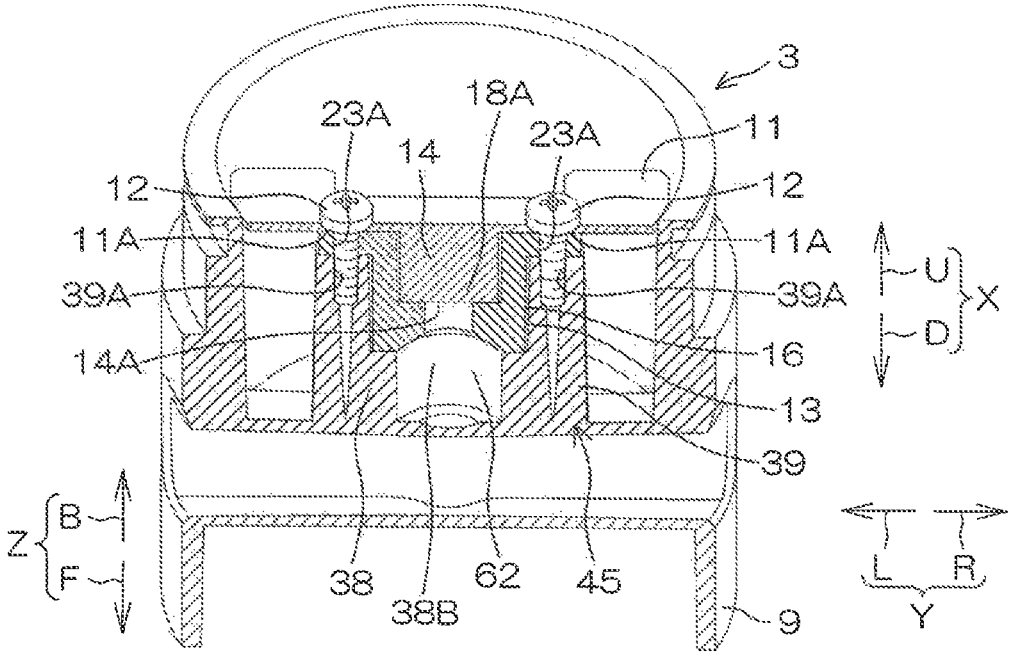
FIG. 17C is a perspective view showing a section (a section at a line XVIIc-XVIIc of FIG. 8) at a position indicated by an arrow c of FIG. 17A.

Referring to FIG. 17B, a pair of the fitting parts 21 provided in the main body part 16 are sandwiching the cylindrical pipe 38 longitudinally and laterally and each of left-and-right pair of the lateral substrate holding part 39 is inserted into the space 22A of a pair of the supporting parts 17 from the lower side D in the assembled sound source holder 13. Also, the inner space 16A of the main body part 16 is communicating with the second space part 38B in the cylindrical pipe 38 in the sound source holder 13.

Then, the sound source mount substrate 11 is approached to the sound source holder 13 in the inner space 9D from the upper side U and the sound source 14 is fitted into the storage space 18B of the storage part 18 of the sound source holder 13 from the upper side U. The sound source holder 13 accommodating the sound source 14 in the storage space 18B is holding the sound source mount substrate 11 on the upper side U so as to accommodate the sound source 14 in the storage space 18B. Therefore, the sound source mount substrate 11 is placed on the sound source holder 13 from the upper side U. Also, the sound emitting part 14A at a lower surface of the sound source 14 accommodated in the storage space 18B is exposed in the first sound guiding space part 19B of the first sound guiding pipe 19 of the sound source holder 13 from the upper side U. That is, the first sound guiding pipe 19 is extended to the lower side D from the sound emitting part 14A. Also, a pair of the through holes 11A of the sound source mount substrate 11 are communicating with the through holes 23A of a pair of the supporting parts 17 of the sound source holder 13 from the upper side U, respectively (refer to FIG. 6).

In this situation, each of a pair of the through holes 11A of the sound source mount substrate 11 is communicating with the screw hole 39A of the substrate holding part 39 from the upper side U via the through hole 23A of the supporting part 17 (refer to FIG. 6). Also, an arc part of the sound source mount substrate 11 is positioned along the inner peripheral surface 9C of the main body case 9 from the rear side B (refer to FIG. 17A). In this connection, the sound source mount substrate 11 is formed so as to have proper size to be accommodated in the inner space 9D of the main body case 9 having the smallest diameter, in order that the sound source mount substrate 11 can be shared in a variety of the main body cases 9 having different diameters.

Finally, as shown in FIG. 17C, each of the bolts 12 is inserted into each of the through holes 11A of the sound source mount substrate 11 and each of the through holes 23A of the supporting part 17 from the upper side U respectively and screwed into the screw hole 39A of the substrate holding part 39. Thereby, both of the sound source mount substrate 11 and the sound source holder 13 are fixed to the guide space forming member 45 of the main body case 9. Thereby, the acoustic unit 3 is completed.

In such a case that the sound source 14 is mounted to the guide space forming member 45, the sound source holder 13 is placed on the guide space forming member 45, then the sound source mount substrate 11 is mounted on the sound source holder 13. Thereby, easiness to mount the sound source 14 is improved. Therefore, productivity of the acoustic unit 3 can be improved.

Figure 18A:
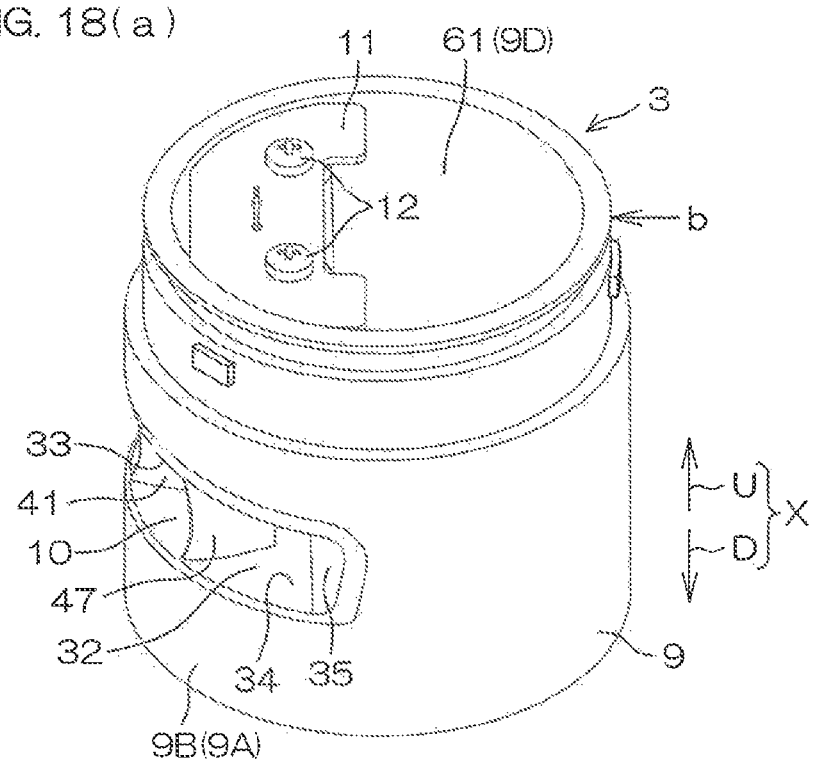
FIG. 18 (*a*) is a perspective view of the acoustic unit 3 seen from a right-upper side, FIG. 18 (*b*) is a perspective view showing a section (a section at a line XVIIIb-XVIIIb of FIG. 8) at a position indicated by an arrow b of FIG. 18 (*a*).
Figure 18B:
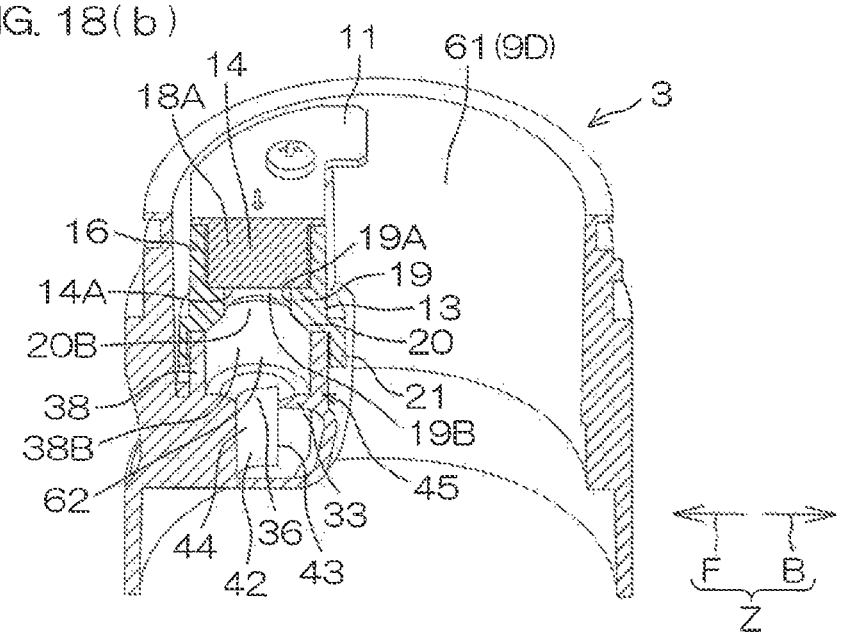

FIG. 18 (*a*) is a perspective view of the acoustic unit 3 seen from the right-upper side, FIG. 18 (*b*) is a perspective view showing a section at a position indicated by an arrow b of FIG. 18 (*a*).

Referring to FIG. 18, the sound source holder 13 is positioned over the upper main wall 33 of the main body case 9 in the completed acoustic unit 3. An area to the rear side B with respect to the sound source mount substrate 11 in the inner space 9D of the main body case 9 is penetrating the main body case 9 vertically, as an approximately semi columnar space 61 for the wiring. The cable (not shown) mentioned above as the wiring of the signal unit 2 is accommodated in the space 61. Thereby, the whole signal indicator lamp 1 can be configured to be compact. Also, the space 61 having an approximately semi columnar shape can accommodate a substrate having width corresponding to a diameter of the space 61 (an inner diameter of the main body case 9). This substrate is a mount substrate configuring the light emitting unit (mentioned above) in the signal unit 2.

Figure 19:
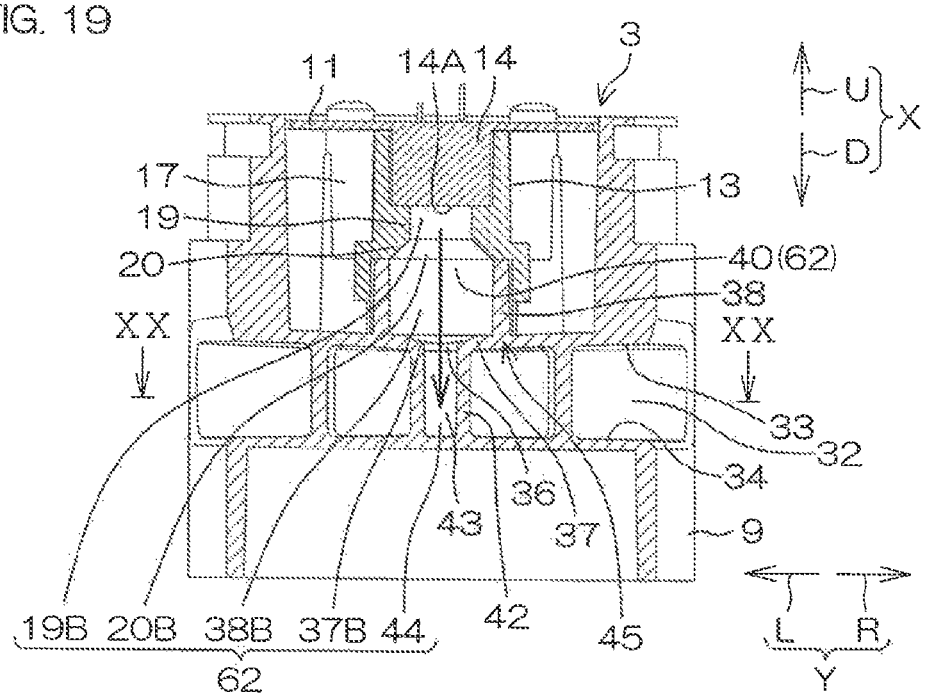
FIG. 19 is a XIX-XIX arrow sectional view of FIG. 8.
Figure 20:
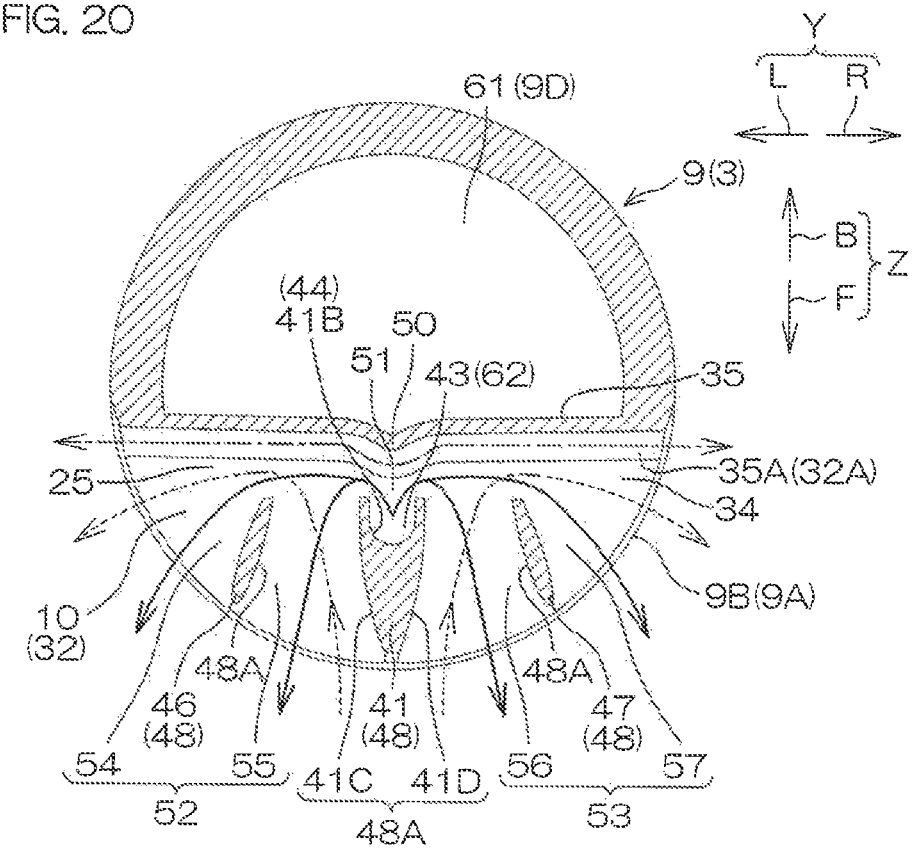
FIG. 20 is a XX-XX arrow sectional view of FIG. 19.

FIG. 19 is a XIX-XIX arrow sectional view of FIG. 8. FIG. 20 is a XX-XX arrow sectional view of FIG. 19.

Referring to FIG. 19, the first tilting pipe 20 and the first space part 20B of the sound source holder 13 is put (placed) on the upper opening 40 of the cylindrical pipe 38 in the completed acoustic unit 3. Moreover, the upper opening 40 is connected to the first tilting pipe 20 and the first space part 20B. Thereby, the guide space forming member 45 whose part is configured by the cylindrical pipe 38 forms the guide space 62 cooperatively with the sound source holder 13.

The guide space 62 is a space extending in the vertical direction X and configured by the first sound guiding space part 19B, the first space part 20B, the second space part 38B, the third space part 37B and the second sound guiding space part 44. The first sound guiding space part 19B, the first space part 20B, the second space part 38B, the third space part 37B and the second sound guiding space part 44 are aligned in this order from the upper side U in the guide space 62. The output opening 43 communicating with the second sound guiding space part 44 is provided at a lower side in the guide space 62. The guide space 62 is enlarged gradually at the first space part 20B from the first sound guiding space part 19B and narrowed gradually at the third space part 37B, and then, connected to the output opening 43 via the second sound guiding space part 44, seen from the upper side U.

Sound generated from the sound emitting part 14A of the sound source 14 is guided to the lower side D by the guide space 62. The sound is outputted to an opposing space (inside of the recess part 32) between the upper main wall 33 and the lower main wall 34 from the upper side U by the output opening 43.

In detail, as shown by a thick solid arrow in FIG. 19, sound generated by the sound source 14 is guided to the lower side D by the first sound guiding pipe 19 in the first sound guiding space part 19B at first. Then, the sound passes the first space part 20B, the second space part 38B, the third space part 37B and the second sound guiding space part 44 in this order and reaches the output opening 43.

The sound which has reached the output opening 43 is guided to the rear surface 41B of the front main wall 41 as shown by a thick solid arrow in FIG. 20. Thereby, the sound is outputted from the output opening 43 to the back surface 32A (the front surface 35A of the rear main wall 35) of the recess part 32. Then, the sound is reflected to the front side F at the back surface 32A. That is, the front main wall 41 guides sound outputted from the output opening 43 to the rear side B by the rear surface 41B and the rear main wall 35 reflects sound outputted from the output opening 43 to the front side F.

Also, the projection part 50 provided in the back surface 32A guides sound laterally which is outputted from the output opening 43 and reflected at the back surface 32A. Thereby, sound reflected to the front side F at the back surface 32A goes to the front side F as expanding laterally in the recess part 32. At this moment, three guide members 48 guide sound reflected to the front side F at the back surface 32A, to the front side F of the main body case 9.

Then, the sound going to the front side F in the recess part 32 in this way is notified to the front side F of the acoustic unit 3 from the opening 10.

Referring to FIG. 19, a part of the guide space 62 is configured by the first sound guiding space part 19B, the first space part 20B, the second space part 38B and the second sound guiding space part 44. The first sound guiding space part 19B is extending from the sound emitting part 14A of the sound source 14 to the lower side D. The first space part 20B is enlarged from the first sound guiding space part 19B to the lower side D. The second space part 38B is extending cylindrically to the lower side D from the upper opening 40 connected to the first space part 20B. The second sound guiding space part 44 is communicating the lower opening 36 and the output opening 43 with each other. The lower opening 36 is provided under the second space part 38B and narrower than the upper opening 40.

The guide space 62 has a configuration where a lower side of the second space part 38B is narrowed by the lower opening 36. In this guide space 62, sound generated from the sound emitting part 14A resonates by the principle of the Hermholtz and is outputted from the output opening 43.

Generally, if air vibrating for generating sound generates Karman vortex, air-flow becomes bad and impede improvement of sound volume. Generation of Karman vortex can be prevented by the first space part 20B expanded from the first sound guiding space part 19B to the lower side D. Therefore, air vibrating for generating sound flows smoothly to the output opening 43 in the guide space 62. Thereby, sound pressure of sound outputted from the output opening 43 is improved. Therefore, sound volume can be improved.

Also, the third space part 37B is tapered to the lower opening 36. Thereby, generation of Karman vortex between the second space part 38B and the second sound guiding space part 44 can be prevented. Therefore, air vibrating for generating sound flows further smoothly to the output opening 43 in the guide space 62. Thereby, sound pressure of sound outputted from the output opening 43 is further improved.

In this way, vertical corner areas in the second space part 38B is chamfered by the first space part 20B and the third space part 37B defined in a taper shape. Therefore, air can be smoothly flowed from the sound source 14 to the output opening 43 in the guide space 62.

In this connection, it is thought that one of the reasons impeding improvement of sound pressure is interference between a sound wave going to the output opening 43 and a reflected wave reflected to a side of the sound source 14 in the guide space 62. In this case, the third space part 37B diffuses and mitigates the reflected wave. Thereby, the interference mentioned above is suppressed. And sound pressure can be improved by the third space part 37B, too.

Referring to FIG. 20, sound outputted from the output opening 43 is reflected at the back surface 32A. At this moment, this sound is guided laterally by the projection part 50 opposing to the output opening 43 from the rear side B in the back surface 32A. And sound reflected at the back surface 32A of the recess part 32 can be smoothly guided and notified to the front side F in condition of avoiding the output opening 43. Therefore, sound pressure to the front side F is increased in the acoustic unit 3. Therefore, sound volume can be further improved.

Also, the guide member 48 provided in the recess part 32 can smoothly guide sound reflected at the back surface 32A of the recess part 32 to the front side F of the main body case 9. Accordingly, sound volume can be further improved. In this connection, the guide member 48 is preferred to be as thin as possible in order to guide sound to the front side F more smoothly.

Moreover, the opposing surfaces 48A neighboring to each other are formed to be estranged with each other toward the front side F, as mentioned above. Therefore, sound reflected at the back surface 32A of the recess part 32 is amplified between these opposing surfaces 48A. Therefore, sound volume can be further improved.

Also, each of the front tip parts 41A, 46A and 47A is extended to the neighborhood of the outer edge of the main body case 9 (refer to FIG. 12 (*c*)). Thereby, it is possible to surely guide sound reflected to the front side F at the rear main wall 35 to the front side F of the main body case 9. Accordingly, sound volume of the acoustic unit 3 can be improved.

In this way, sound volume of this the acoustic unit 3 is improved by its structural feature. Of course, sound volume can be further improved by synergism between the structural feature mentioned above and an electrical feature of the sound source 14, if a high output type is selected as the sound source 14.

On the other hand, getting wet of the acoustic unit 3 is possible due to some usage of the acoustic unit 3. In the acoustic unit 3, the inner space 9D is closed by the signal unit 2 and the base 5 from the vertical direction (refer to FIG. 2). Therefore, the opening 10 of the front surface 9B of the main body case 9, the recess part 32 recessed to the rear side B from the opening 10 and the guide space 62 mentioned above are thought to be a penetration route of water into the main body case 9. That is, it is possible that water is splashed to the main body case 9 from the front side F and enters into the recess part 32 from the opening 10 and rises in the guide space 62 from the output opening 43 and reaches the sound source 14.

However, the front main wall 41 is positioned as a drip-proof wall at the front side F of the output opening 43 in the recess part 32. Thereby, entering of water (water droplet in detail) from the front side F to the output opening 43 is prevented. Particularly, the output opening 43 is covered from the front side F by the rear surface 41B convexly curved to the front side F in the front main wall 41. Accordingly, entering of water droplet into the output opening 43 from the front side F is further prevented. Also, the output opening 43 is opposing to the back surface 32A from the front side F. Therefore, if water splashes to the main body case 9 from the front side F, this water does not directly splash to the output opening 43. Therefore, it is difficult for water from the front side F to reach the sound source 14 and the sound source mount substrate 11 (refer to FIG. 19) from the output opening 43. Therefore, waterproofness can be further improved.

Also, the sound source 14 and the sound source mount substrate 11 are placed away across the guide space 62 from the output opening 43 to the upper side U (refer to FIG. 19). Thereby, if water splashes to the output opening 43, this water hardly reaches the sound source 14 and the sound source mount substrate 11. Therefore, waterproofness can be improved.

Also, the first space 51, the second space 52 and the third space 53 are communicating with one other along the crosswise direction Y at a rear end part of each of these spaces, as mentioned above. Therefore, if water enters into any one of the first space 51, the second space 52 and the third space 53, this water flows in the rear end part of each of these spaces along the crosswise direction Y as shown by a broken arrow. Therefore, this water easily exits from the main body case 9 without entering the output opening 43.

Also, in this embodiment, the left main wall 46 is dividing the second space 52 into the fourth space 54 and the fifth space 55, and the right main wall 47 is dividing the third space 53 into the sixth space 56 and the seventh space 57. The first space 51, the fourth space 54, the fifth space 55, the sixth space 56 and the seventh space 57 are communicating with one another along the crosswise direction Y at a rear end part of each of these spaces. Therefore, if water enters into any one of these spaces, this water flows in the rear end part of each of these spaces along the crosswise direction Y as shown by a broken arrow. Therefore, this water easily exits from the main body case 9 without entering the output opening 43.

Also, each part communicating along the crosswise direction Y of the first space 51, the fourth space 54, the fifth space 55, the sixth space 56 and the seventh space 57 is penetrating the main body case 9 along the crosswise direction Y as the opening 25 mentioned above. Therefore, water entering the main body case 9 from the front side F flows in the opening 25 communicating along the crosswise direction Y of each of these spaces along the crosswise direction Y as shown by a broken arrow. Then, the water easily exits from the main body case 9 without changing a flow direction of the water. Also, when water enters the main body case 9 from the crosswise direction Y, this water flows in the opening 25 communicating along the crosswise direction Y of each of these spaces along the crosswise direction Y and easily exits from the main body case 9 without changing a flow direction of the water and without splashing to a side of the output opening 43 at the rear main wall 35 as shown by a dash-dotted arrow.

Moreover, the left main wall 46 and the right main wall 47 prevent water directly entering from diagonally forward (for example, 45 degrees with respect to the anteroposterior direction Z and the crosswise direction Y) to a near part of the front surface 35A or the projection part 50 opposing to the output opening 43. Accordingly, the left main wall 46 and the right main wall 47 reduce possibility of water entering to the output opening 43.

As results of the above, waterproofness can be improved because it is difficult for water splashing onto the main body case 9 to reach the output opening 43. Also, in such the acoustic unit 3 that waterproofness can be improved, sound volume can be further improved by enlarging the opening 10.

This invention is not limited to the embodiments mentioned above, and can be variously modified within the scope of the claims.

For example, the signal indicator lamp 1 including the notification device such as the acoustic unit 3 and the signal unit 2 are explained in the embodiments mentioned above. However, the whole signal indicator lamp 1 including the acoustic unit 3 and the signal unit 2 may be regarded as the notification device.

FIG. 21 to FIG. 25 are sectional views of the first to the fifth variation, respectively corresponding to FIG. 20.

Figure 21:
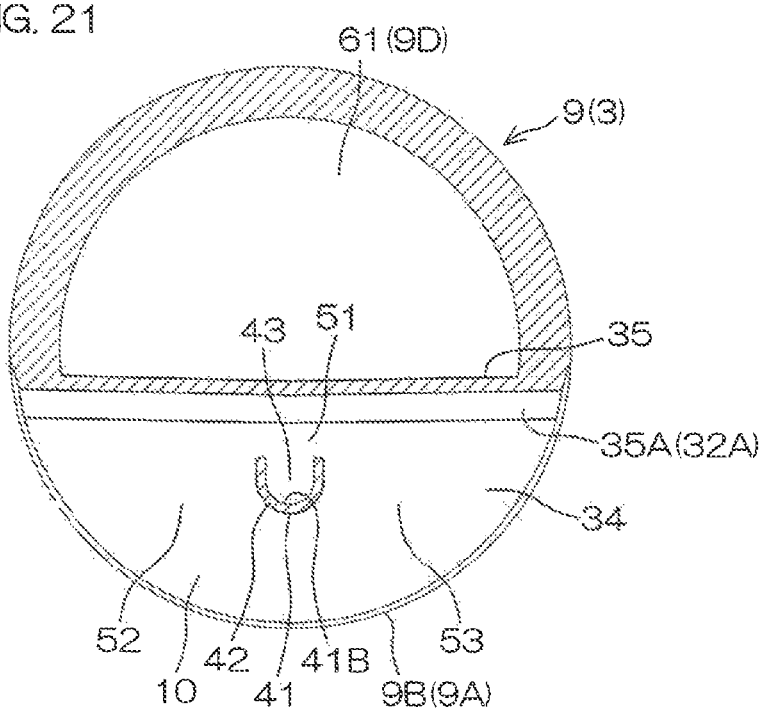
FIG. 21 is a sectional view of a first variation, corresponding to FIG. 20.

If improvement of a fixed waterproofness is prioritized, a part (a part corresponding to the second sound guiding pipe 42) covering the output opening 43 from the front side F in the front main wall 41 should exist at least as shown in FIG. 21 of the first variation. In this case, the left main wall 46 and the right main wall 47 may be omitted. Also, a part where the projection part 50 is provided in the front surface 35A is not flat (refer to FIG. 20) in the embodiment mentioned above. However, a whole area of the front surface 35A may be a flat surface by omitting the projection part 50 from the front surface 35A as shown in the FIG. 21 (this is applicable to the embodiment mentioned above and other variations). In this case, it is possible to flow water entering any one of the first to the seventh spaces 51 to 57 along the front surface 35A which is flat in the rear main wall 35. Thereby, splashing of the water to a side of the output opening 43 at the front surface 35A of the rear main wall 35 can be prevented. Accordingly, waterproofness can be further improved.

Figure 22:
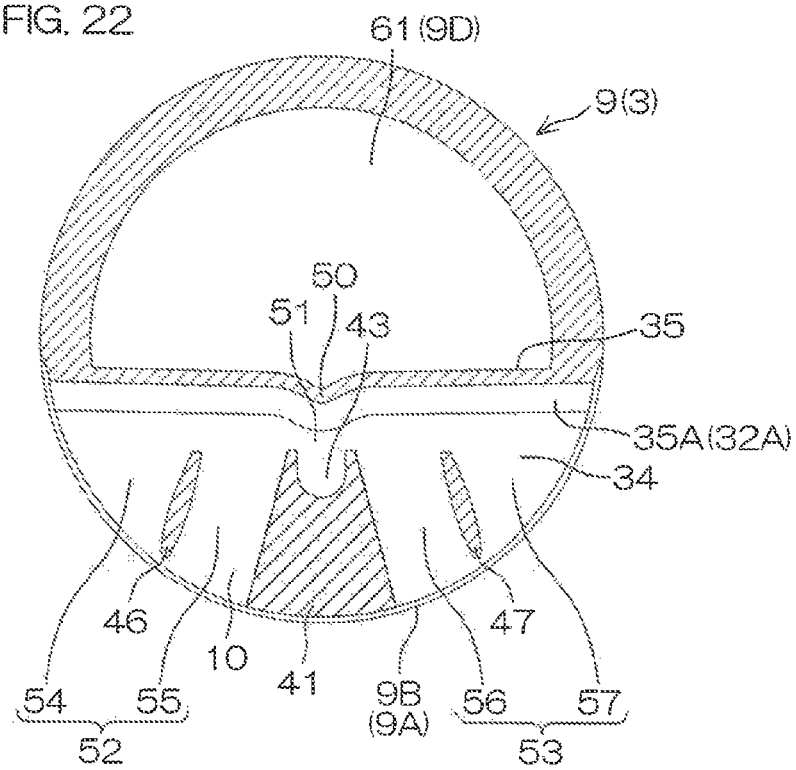
FIG. 22 is a sectional view of a second variation, corresponding to FIG. 20.

Also, the front main wall 41 may be enlarged laterally in order to prioritize improvement of waterproofness as shown in FIG. 22 of the second variation. Thereby, reaching of water from the front side F to the output opening 43 can be further surely prevented.

Figure 23:
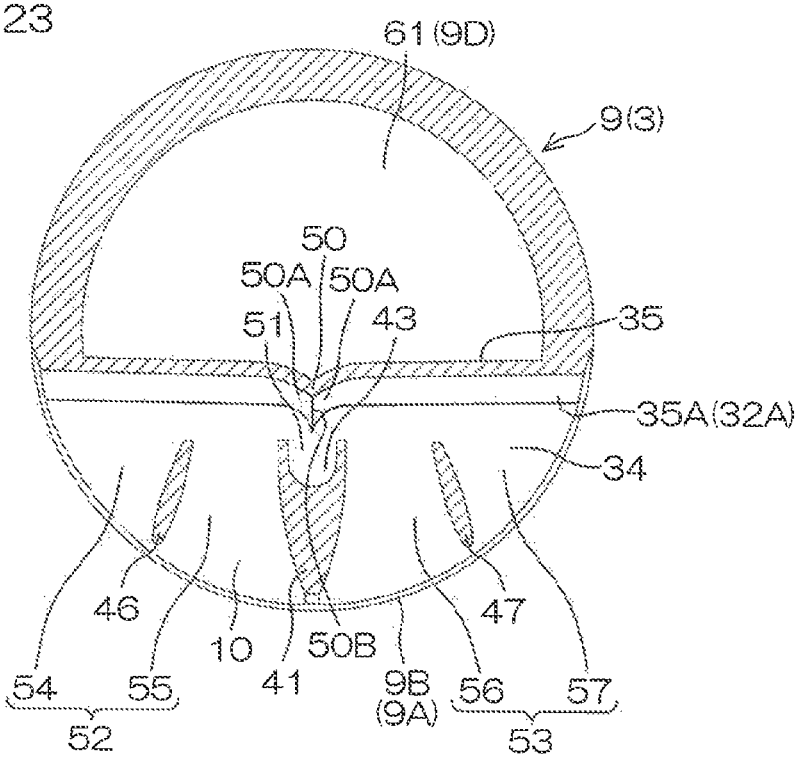
FIG. 23 is a sectional view of a third variation, corresponding to FIG. 20.

On the other hand, the projection part 50 of the front surface 35A of the rear main wall 35 preferably has left-and-right pair of curved surfaces 50A each of which has an arc shape seen from the vertical direction X so as to smoothly guide sound laterally as shown in FIG. 23 of the third variation, if improvement of sound volume is prioritized. These curved surfaces 50A are recessed to each other so as to be along a wave shape of sound outputted from the output opening 43. Front edges of these curved surfaces 50A are connected. Thereby, a front edge 50B of the projection part 50 is projected to the front side F.

Figure 24:
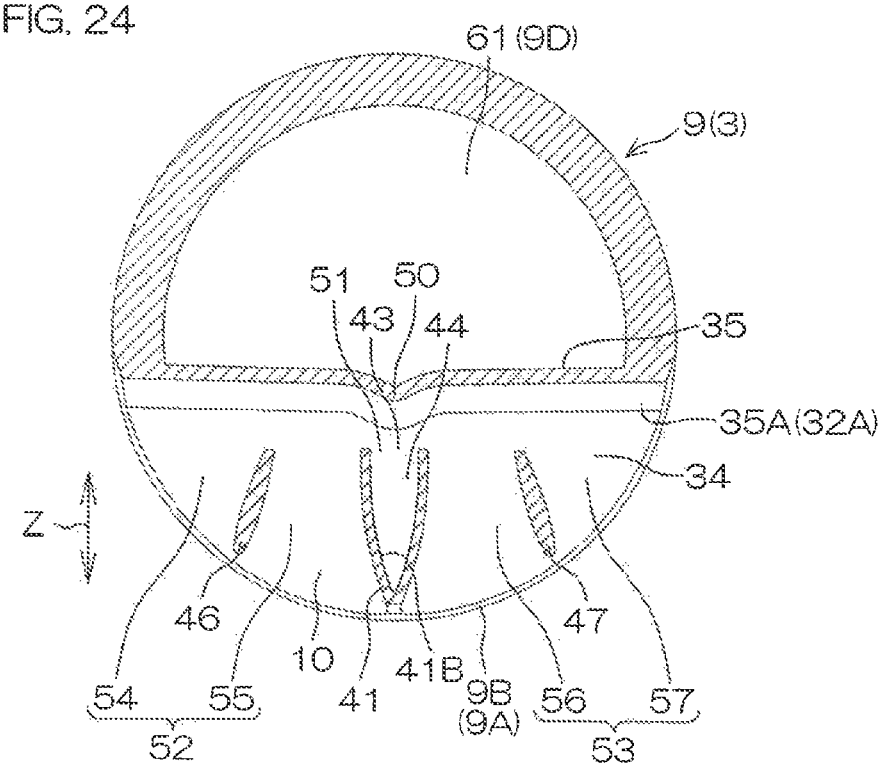
FIG. 24 is a sectional view of a fourth variation, corresponding to FIG. 20.

An interval between the rear surface 41B of the front main wall 41 and the output opening 43 in the anteroposterior direction Z (a depth of the second sound guiding space part 44 in the anteroposterior direction Z) may be broad as shown in FIG. 24 of the fourth variation. However, it is possible that improvement of sound volume is prevented by irregular reflection of sound which has reached the output opening 43, at a space between the rear surface 41B and the output opening 43 (the second sound guiding space part 44) in this configuration. Therefore, the interval in the anteroposterior direction Z between the rear surface 41B of the front main wall 41 and the output opening 43 is preferably as narrow as possible as the embodiment mentioned above (refer to FIG. 20).

Figure 25:
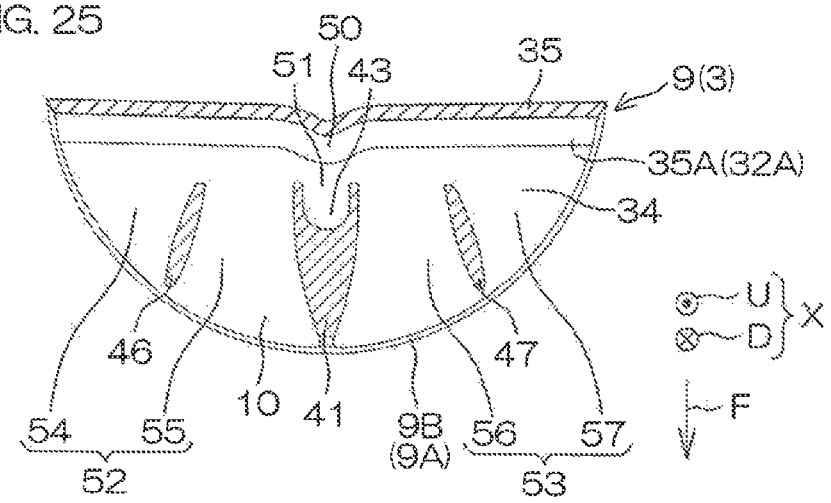
FIG. 25 is a sectional view of a fifth variation, corresponding to FIG. 20.
Figure 26:
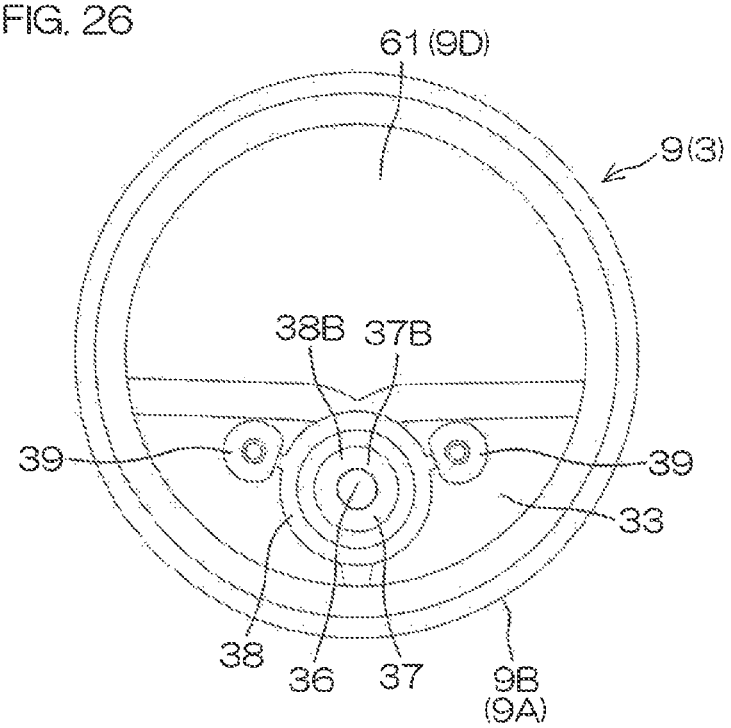
FIG. 26 is a sectional view of a sixth variation, corresponding to FIG. 11.

The main body case 9 may have an outline having a semicircular shape bulging to the front side F seen from the vertical direction X by omitting a part corresponding to the space 61 for the wiring mentioned above (refer to FIG. 20), as shown in FIG. 25 of the fifth variation FIG. 26 is a sectional view of the sixth variation, corresponding to FIG. 11.

Also, the lower opening 36 of the upper main wall 33 of the embodiment mentioned above has a semicircular shape seen from the vertical direction X (refer to FIG. 11) by reason of molding the main body case 9. However, the lower opening 36 preferably has a circular shape seen from the vertical direction X in order to further improve sound volume as shown in FIG. 26 of the sixth variation.

Figure 27A:
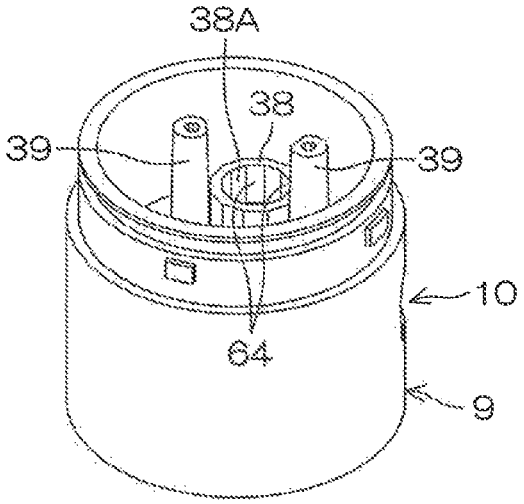
FIG. 27 (*a*) is a perspective view of the main body case 9 of a seventh variation, FIG. 27 (*b*) is a perspective view of the sound source holder 13 of the seventh variation.
Figure 27B:
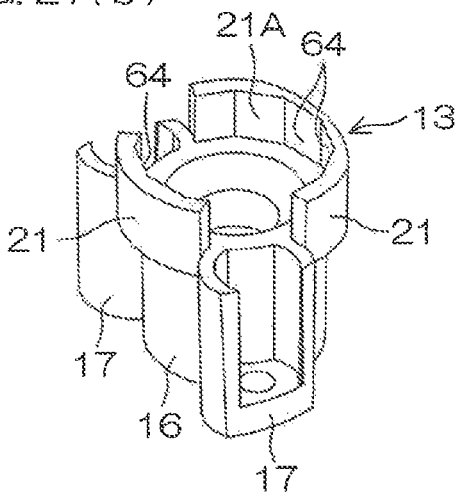

Also, a part shown as a curved surface of components of the acoustic unit 3 in figures mentioned above, may not be the curved surface. The part may be configured by combining a plurality of flat surfaces 64 such as an inner peripheral surface 38A of the cylindrical pipe 38 according to the seventh variation shown in FIGS. 27 (*a*) & 27 (*b*) and an inner peripheral surface 21A of the fitting part 21 of the sound source holder 13.

Figure 28:
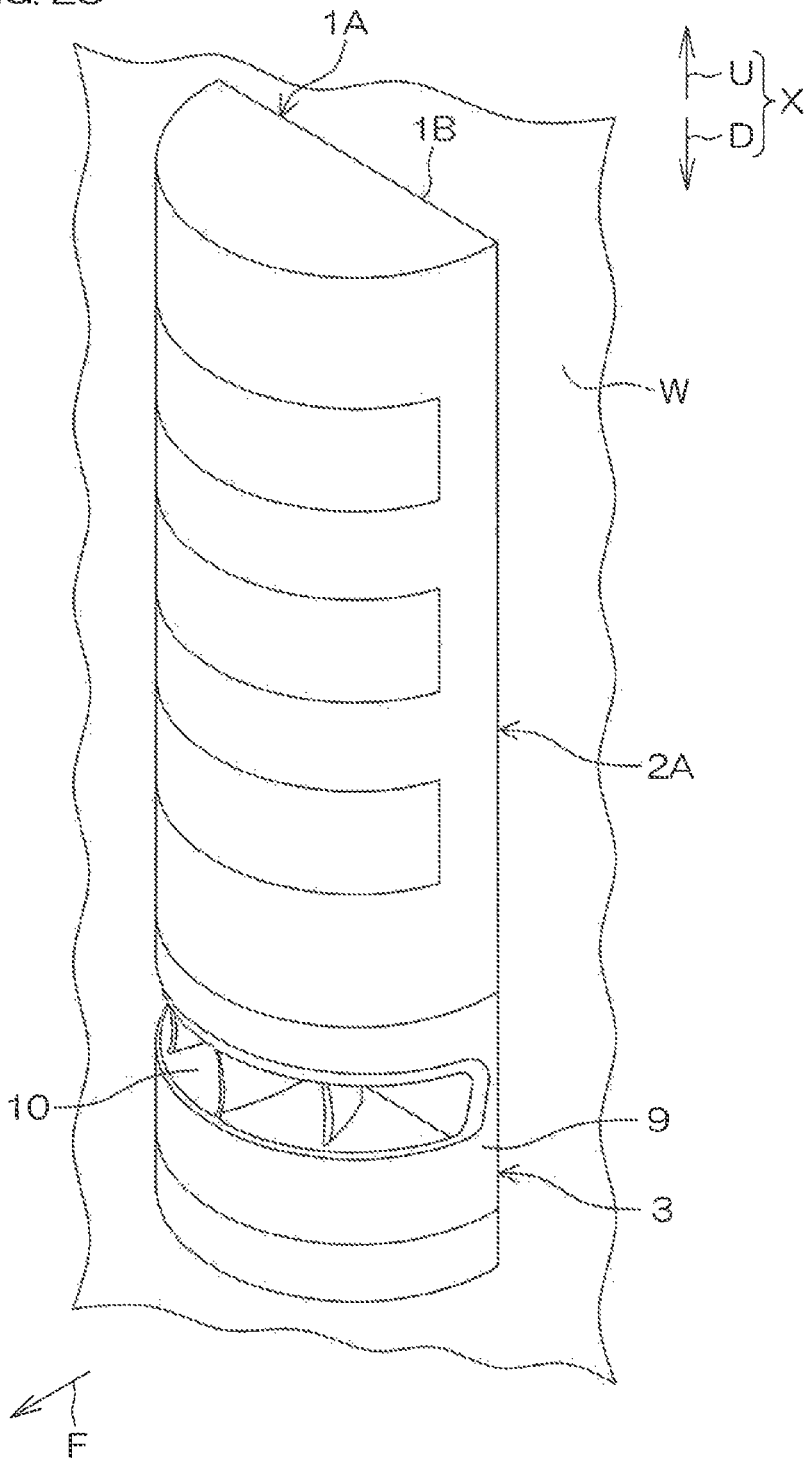
FIG. 28 is a perspective view of a LED lighting 1A of an eighth variation of the signal indicator lamp 1.
Figure 29:
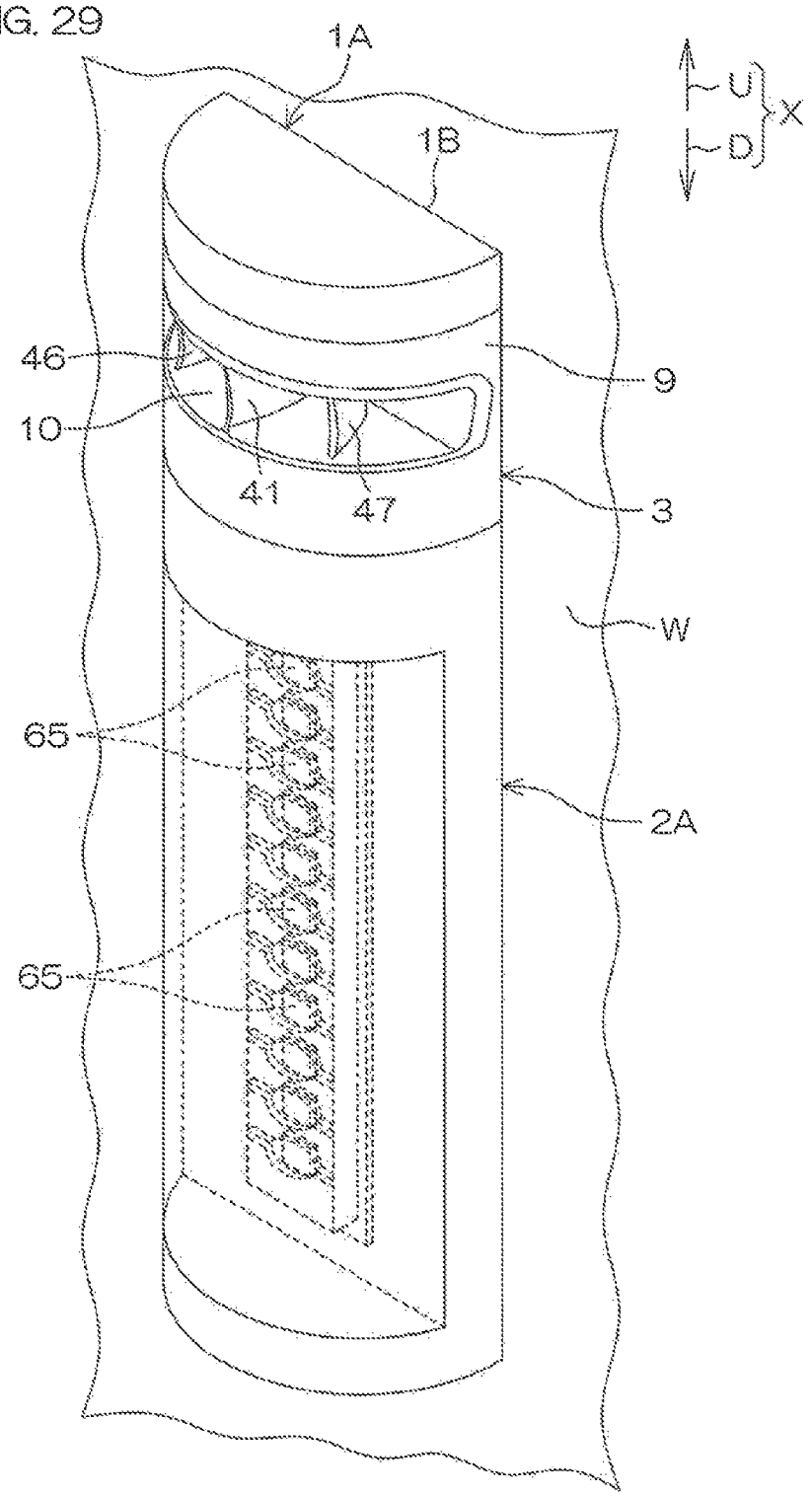
FIG. 29 is a perspective view of a LED lighting 1A of a ninth variation.

FIG. 28 is a perspective view of a LED lighting 1A of the eighth variation of the signal indicator lamp 1. FIG. 29 is a perspective view of a LED lighting 1A of the ninth variation.

The LED lighting 1A may be used by being fixed to a wall surface W of a field such as the eighth variation of FIG. 28 and the ninth variation of FIG. 29. In the eighth variation and the ninth variation, the acoustic unit 3 has a semicircular shape bulging to the front side F seen from the vertical direction X by applying the fifth variation and the whole of the LED lighting 1A including the light emitting unit 2A has a semicircular shape seen from the vertical direction X. The LED lighting 1A is fixed in order that a flat rear surface 1B thereof extending vertically and laterally is positioned along the wall surface W.

Also, the light emitting unit 2A may be configured by a plurality of LEDs 65 aligning vertically as shown in FIG. 29. Also, the light emitting unit 2A may be placed under the main body case 9 of the acoustic unit 3 in the LED lighting 1A. Of course, a LED lighting 1A having a configuration where the light emitting units 2A are placed both the upper side U and the lower side D of the main body case 9 is possible, too. In this connection, such layout is also possible in the signal indicator lamp 1 shown in FIG. 1.

Also, the signal indicator lamp 1 may be supplied with electric power from an outside power supply via the cables or a built-in battery such as a dry battery via the cables. Also, the signal indicator lamp 1 may have a built-in a radio communication equipment and radio-communicate with an outside apparatus.

REFERENCE SIGNS LIST

1 signal indicator lamp
2 signal unit
3 acoustic unit
9 main body case
14 sound source
32 recess part
33 upper main wall
34 lower main wall
35 rear main wall
35A front surface
41 front main wall
41A front tip part
41B rear surface
41C left surface
41D right surface
43 output opening
46 left main wall
46A front tip part
47 right main wall
47A front tip part
51 first space
52 second space
53 third space
54 fourth space
55 fifth space
56 sixth space
57 seventh space
61 space for a wiring
B rear side
D lower side
F front side
L left side
R right side
U upper side
Y crosswise direction

What is claimed is:

1. A notification device for notifying sound to a front side including:

a sound source; and a main body case including an upper main wall extending longitudinally and laterally, a lower main wall extending longitudinally and laterally and opposing to the upper main wall from a lower side, and an output opening for outputting sound from the sound source to an opposing space between the upper main wall and the lower main wall from an upper side, wherein the main body case includes:

a front main wall provided at a front side of the output opening and bridged between the upper main wall and the lower main wall, the front main wall for preventing entering of a water droplet to the output opening from a front side and for guiding sound outputted from the output opening to a rear side; and a rear main wall extending vertically and laterally and opposing to an output opening side of the front main wall from a rear side with an interval, the rear main wall for reflecting sound outputted from the output opening to a front side, wherein a first space between the front main wall and the rear main wall, a second space surrounded by a left surface of the front main wall and the rear main wall and the upper main wall and the lower main wall, and a third space surrounded by a right surface of the front main wall and the rear main wall and the upper main wall and the lower main wall are communicating with one another along a crosswise direction at a rear end part of each of the first space, the second space and the third space.

2. The notification device according to claim 1, wherein the main body case includes:

a left main wall bridged between the upper main wall and the lower main wall at a position spaced to a left side from the front main wall and spaced to a front side from the rear main wall, the left main wall for guiding sound reflected to a front side at the rear main wall to a front side; and a right main wall bridged between the upper main wall and the lower main wall at a position spaced to a right side from the front main wall and spaced to a front side from the rear main wall, the right main wall for guiding sound reflected to a front side at the rear main wall to a front side, wherein the second space is divided into a fourth space on a left side and a fifth space on a right side by the left main wall, the third space is divided into a sixth space on a left side and a seventh space on a right side by the right main wall, the first space, the fourth space, the fifth space, the sixth space and the seventh space are communicating with one another along the crosswise direction at a rear end part of each of the first space, the fourth space, the fifth space, the sixth space and the seventh space.

3. The notification device according to claim 2, wherein each part communicating along the crosswise direction of the first space, the fourth space, the fifth space, the sixth space and the seventh space is penetrating the main body case along the crosswise direction.

4. The notification device according to claim 3, wherein a front surface of the rear main wall is a flat surface.

5. The notification device according to claim 3, wherein a rear surface of the front main wall is convexly curved to a front side.

6. The notification device according to claim 4, wherein a rear surface of the front main wall is convexly curved to a front side.

7. The notification device according to claim 2, wherein the front main wall, the left main wall and the right main wall are integrally molded with the main body case.

8. The notification device according to claim 7, wherein a front surface of the rear main wall is a flat surface.

9. The notification device according to claim 7, wherein a rear surface of the front main wall is convexly curved to a front side.

10. The notification device according to claim 2, wherein a front surface of the rear main wall is a flat surface.

11. The notification device according to claim 10, wherein a rear surface of the front main wall is convexly curved to a front side.

12. The notification device according to claim 2, wherein a rear surface of the front main wall is convexly curved to a front side.

13. The notification device according to claim 2, wherein each front tip part of the front main wall, the left main wall and the right main wall is extended to the neighborhood of an outer edge of the main body case.

14. A signal indicator lamp including the notification device according to claim 1, further including a signal unit for transmitting predetermined signal at least one of an upper side and a lower side of the main body case.

15. The signal indicator lamp according to claim 14, wherein the main body case includes a space for a wiring of the signal unit at a rear side of the main body case.

16. The signal indicator lamp according to claim 14, wherein the main body case includes:

a left main wall bridged between the upper main wall and the lower main wall at a position spaced to a left side from the front main wall and spaced to a front side from the rear main wall, the left main wall for guiding sound reflected to a front side at the rear main wall to a front side; and a right main wall bridged between the upper main wall and the lower main wall at a position spaced to a right side from the front main wall and spaced to a front side from the rear main wall, the right main wall for guiding sound reflected to a front side at the rear main wall to a front side, wherein the second space is divided into a fourth space on a left side and a fifth space on a right side by the left main wall, the third space is divided into a sixth space on a left side and a seventh space on a right side by the right main wall, the first space, the fourth space, the fifth space, the sixth space and the seventh space are communicating with one another along the crosswise direction at a rear end part of each of the first space, the fourth space, the fifth space, the sixth space and the seventh space.

17. The signal indicator lamp according to claim 16, wherein each part communicating along the crosswise direction of the first space, the fourth space, the fifth space, the sixth space and the seventh space is penetrating the main body case along the crosswise direction.

18. The signal indicator lamp according to claim 16, wherein a front surface of the rear main wall is a flat surface.

19. The signal indicator lamp according to claim 16, wherein a rear surface of the front main wall is convexly curved to a front side.

20. A notification device including a signal unit for transmitting predetermined signal and an acoustic unit connected with the signal unit for notifying sound to a front side, wherein the acoustic unit includes:

a sound source; and a main body case including an upper main wall extending longitudinally and laterally, a lower main wall extending longitudinally and laterally and opposing the upper main wall from a lower side, and an output opening for outputting sound from the sound source to an opposing space between the upper main wall and the lower main wall from an upper side, wherein the main body case includes:

a front main wall provided at a front side of the output opening and bridged between the upper main wall and the lower main wall, the front main wall for preventing entering of a water droplet to the output opening from a front side and for guiding sound outputted from the output opening to a rear side; and a rear main wall extending vertically and laterally and opposing to an output opening side of the front main wall from a rear side with an interval, the rear main wall for reflecting sound outputted from the output opening to a front side, wherein a first space between the front main wall and the rear main wall, a second space surrounded by a left surface of the front main wall and the rear main wall and the upper main wall and the lower main wall, and a third space surrounded by a right surface of the front main wall and the rear main wall and the upper main wall and the lower main wall are communicating with one another along a crosswise direction at a rear end part of each of the first space, the second space and the third space.

* * * * *